US010642193B2

(12) United States Patent
Tanaka et al.

(10) Patent No.: US 10,642,193 B2
(45) Date of Patent: May 5, 2020

(54) POWDER CONTAINER AND IMAGE FORMING APPARATUS INCORPORATING SAME

(71) Applicants: Yuuta Tanaka, Shizuoka (JP); Ryoichi Teranishi, Kanagawa (JP); Toshihide Tomotaka, Shizuoka (JP); Seiji Terazawa, Shizuoka (JP); Keiichi Yano, Tokyo (JP)

(72) Inventors: Yuuta Tanaka, Shizuoka (JP); Ryoichi Teranishi, Kanagawa (JP); Toshihide Tomotaka, Shizuoka (JP); Seiji Terazawa, Shizuoka (JP); Keiichi Yano, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/320,532

(22) PCT Filed: Aug. 29, 2017

(86) PCT No.: PCT/JP2017/030929
§ 371 (c)(1),
(2) Date: Jan. 25, 2019

(87) PCT Pub. No.: WO2018/051779
PCT Pub. Date: Mar. 22, 2018

(65) Prior Publication Data

US 2019/0243286 A1 Aug. 8, 2019

(30) Foreign Application Priority Data

Sep. 15, 2016 (JP) ..... 2016-180976

(51) Int. Cl.
*G03G 15/08* (2006.01)
*B65D 83/06* (2006.01)

(52) U.S. Cl.
CPC ..... *G03G 15/0891* (2013.01); *B65D 83/06* (2013.01); *G03G 15/0872* (2013.01); *G03G 2215/085* (2013.01)

(58) Field of Classification Search
None
See application file for complete search history.

(56) References Cited

U.S. PATENT DOCUMENTS 6,751,431 B2 * 6/2004 Ichikawa ..... G03G 15/0868 399/262
2007/0077100 A1 4/2007 Suzuki et al.
(Continued)

FOREIGN PATENT DOCUMENTS

EP 2 806 312 A1 11/2014
JP 2003-241496 A 8/2003
(Continued)

OTHER PUBLICATIONS

International Search Report and Written Opinion dated Nov. 21, 2017 in PCT/JP2017/030929 filed on Aug. 29, 2017.

*Primary Examiner* — Victor Verbitsky
(74) *Attorney, Agent, or Firm* — Oblon, McClelland, Maier & Neustadt, L.L.P.

(57) ABSTRACT

An object of this disclosure is to reduce differences in the drawn amount of the parison around the mouth of the toner container, thereby reducing the amount of resin for the toner container and the weight thereof. A powder container includes a cylindrical container body to rotate in a horizontal posture, a cylindrical mouth at a first end of the container body, smaller in diameter than the container body, a conveyor to convey the powder inside the container body toward the mouth, a scooping portion deeper in the container body than the mouth, to lift the powder above a powder inlet of a conveying tube inserted from the mouth and drop the powder to the powder inlet, and a radially inner face
(Continued)

continuous with an inner end of the scooping portion, extending in a direction crossing the scooping portion and disposed inward in the radial direction than an outermost face of the container body. The radially inner face extends from the mouth toward a second end of the container body and is not inner in the radial direction than an inner rim of the mouth.

7 Claims, 31 Drawing Sheets

(56) References Cited

U.S. PATENT DOCUMENTS

| | | | |
|---|---|---|---|
| 2013/0330106 | A1 | 12/2013 | Mitsuishi et al. |
| 2014/0064795 | A1 | 3/2014 | Terazawa et al. |
| 2014/0270859 | A1 | 9/2014 | Hosokawa et al. |
| 2014/0348551 | A1 | 11/2014 | Yamabe et al. |
| 2015/0293474 | A1 | 10/2015 | Mitsuishi et al. |
| 2016/0124346 | A1 | 5/2016 | Yamabe et al. |
| 2016/0161885 | A1 | 6/2016 | Hosokawa et al. |
| 2016/0202632 | A1 | 7/2016 | Mitsuishi et al. |
| 2016/0252846 | A1 | 9/2016 | Suiseki et al. |
| 2017/0102638 | A1 | 4/2017 | Yamabe et al. |
| 2017/0108799 | A1 | 4/2017 | Hosokawa et al. |
| 2017/0139350 | A1 | 5/2017 | Yano et al. |

FOREIGN PATENT DOCUMENTS

| | | | |
|---|---|---|---|
| JP | 2005-193575 | A | 7/2005 |
| JP | 2005-221825 | A | 8/2005 |
| JP | 2009-276659 | A | 11/2009 |
| JP | 2011-64775 | A | 3/2011 |
| JP | 2014-112120 | A | 6/2014 |
| JP | 2014-228635 | A | 12/2014 |

* cited by examiner

POWDER CONTAINER AND IMAGE FORMING APPARATUS INCORPORATING SAME

TECHNICAL FIELD

This disclosure generally relates to a powder container and an image forming apparatus, such as a copier, a printer, a facsimile machine, or a multifunction peripheral having at least two of copying, printing, facsimile transmission, plotting, and scanning capabilities.

BACKGROUND ART

Toner containers used in electrophotographic image forming apparatuses are typically made of resin and manufactured through injection molding or blow molding. In blow molding, a hollow parison made of resin is softened by heating and set inside a mold. The inside of the parison is blown with air to draw the parison and make the resin tightly contact an inner face of the mold, thereby shaping the resin into a predetermined shape. For example, Patent Documents 1 to 3 disclose such processes.

CITATION LIST

Patent Literature

PTL 1: JP-2003-241496-A
PTL 2: JP-2005-221825-A
PTL 3: JP-342958-B JP-2009-276659-A

SUMMARY OF INVENTION

Technical Problem

To manufacture toner containers through blow molding, if the toner container to be manufactured has a constricted portion (e.g., a neck) significantly narrower than another portion, the amount by which the resin is drawn (hereinafter $B!H (Bdrawn amount $B!I (B) sharply changes around the constricted portion. Then, the thickness of the toner container tends to become uneven. The thickness becomes uneven because the constricted portion causes differences in the timing of contact of the parison with the mold. Specifically, a portion of the parison that contacts the mold at an earlier timing hardens due to temperature drop, and the hardened portion is less easily drawn and remains relatively thick. By contrast, another portion (adjacent to the neck portion) that contacts the mold at a later timing is drawn more to be thinner. Thus, the thickness becomes uneven.

Regarding toner containers, a minimum thickness standard is specified to maintain flame retardancy. To meet the minimum thickness requirement, it is necessary to adjust the thickness of the parison considering the drawn amount of the thin portion. However, adjusting the thickness of the parison finely in divided sections is difficult. Accordingly, the thickness is adjusted to make the entire parison thick. Therefore, the amount of resin used to manufacture toner containers increases, and toner containers tends to be heavy.

In view of the foregoing, an object of this disclosure is to reduce the amount of resin used to manufacture a toner container and provide a toner container having a reduced weight.

Solution to Problem

In order to achieve the above-described object, there is provided a powder container as described in appended claims. Advantageously, the powder container includes a container body, having a substantially cylindrical shape, to contain powder and rotate around an axis in a horizontal posture. The powder container further includes a mouth having a cylindrical shape and smaller in inner diameter than the container body. The mouth is disposed at a first end of the container body in an axial direction of the container body, and a conveying tube having a powder inlet is inserted into the mouth. The powder container further includes a conveyor disposed inside the container body to convey the powder toward the mouth as the container body rotates. In the container body, a scooping portion is disposed deeper than the mouth in the axial direction and raised toward the axis of the container body to reduce an inner diameter of the container body. A radially inner face is continuous with an inner end of the scooping portion in a radial direction of the container body. The radially inner face extends in a direction crossing the scooping portion and is disposed inward in the radial direction than an outermost face of the container body. The scooping portion is configured to lift the powder inside the container body, to a position above the powder inlet of the conveying tube, and drop the powder to the powder inlet as the container body rotates. The radially inner face extends from the mouth toward a second end of the container body opposite the first end in the axial direction. The radially inner face is not inner in the radial direction than a virtual cylinder extending from an inner rim of the mouth, parallel to the axial direction.

Advantageous Effects of Invention

Accordingly, the amount of resin used to manufacture the powder container can be reduced, and the weight of the toner container can be reduced.

DESCRIPTION OF EMBODIMENTS

Figure 1:
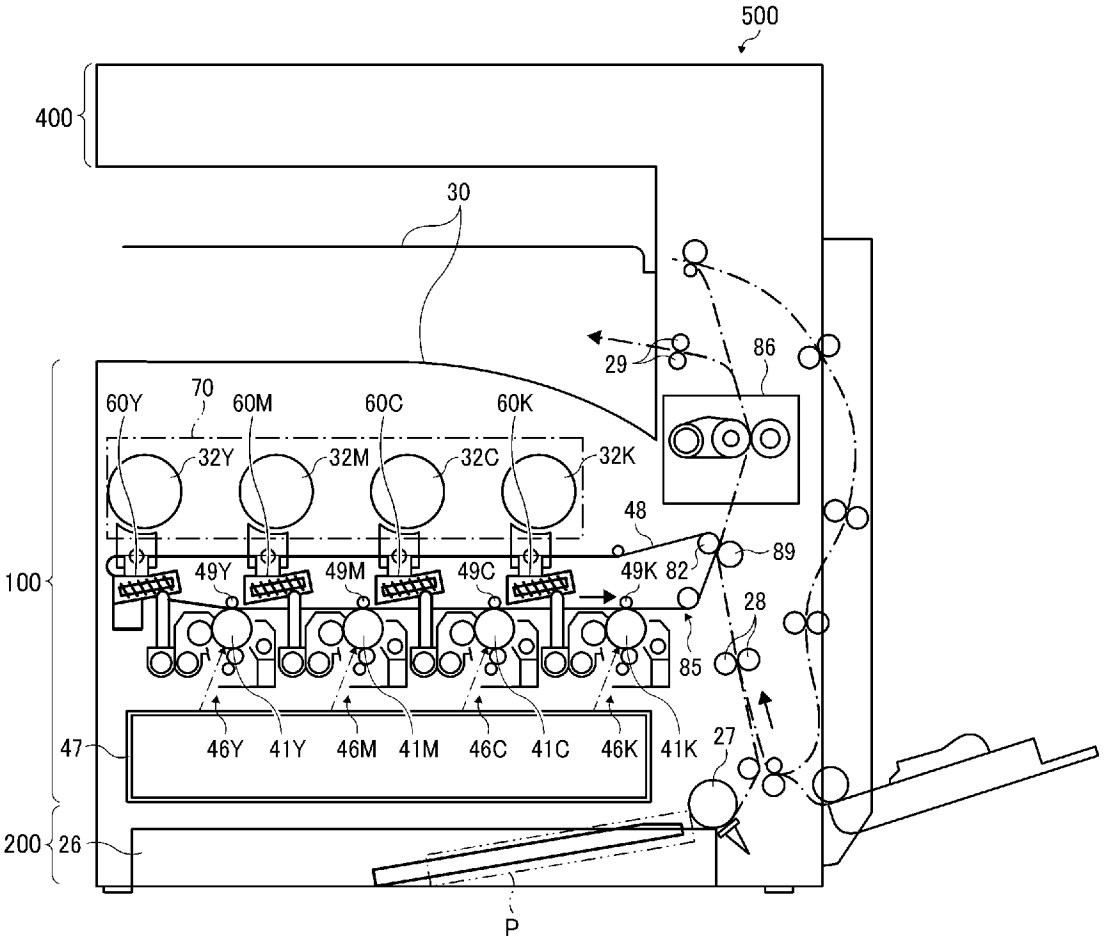
FIG. 1 is a schematic cross-sectional view of an image forming apparatus according to an embodiment.

Referring now to the drawings, wherein like reference numerals designate identical or corresponding parts throughout the several views thereof, embodiments according to this disclosure are described in detail below. However, elements, types, combinations of elements, shapes of the elements, and relative positions of components in the embodiments are examples and do not limit the scope of appended claims.

Structure of Image Forming Apparatus

With reference to FIG. 1, a description is given of an image forming apparatus according to an embodiment.

FIG. 1 is a schematic view of a general structure of an image forming apparatus 500 according to the present embodiment. The image forming apparatus 500 includes a printer body 100 (an example image forming device), a sheet-feeding table or sheet feeder 200, and a scanner 400 disposed above the printer body 100.

The image forming apparatus 500 includes a toner container mount 70 disposed in an upper section of the printer body 100. Four toner containers 32Y, 32M, 32C, and 32K (also collectively $B!H (Btoner containers 32 $B!I (B) to contain yellow, magenta, cyan, and black toners, respectively, are removably installable in the toner container mount 70. That is, the toner containers 32 are replaceable. Below the toner container mount 70, an intermediate transfer unit 85 is disposed.

The intermediate transfer unit 85 includes an intermediate transfer belt 48, four primary-transfer bias rollers 49 (49Y, 49M, 49C, and 49K), a secondary-transfer backup roller 82, multiple tension rollers, and an intermediate-transfer cleaning device. The intermediate transfer belt 48 is supported by the multiple rollers including the secondary-transfer backup roller 82 and is rotated in the direction indicated by an arrow illustrated in FIG. 1 as the secondary-transfer backup roller 82 rotates. The printer body 100 includes four image forming units 46 (46Y, 46M, 46C, and 46K) disposed side by side, facing the intermediate transfer belt 48. Additionally, four toner supply devices 60 (60Y, 60M, 60C, and 60K) corresponding to the respective toner containers 32 are disposed below the toner containers 32. Each toner supply device 60 supplies toner (i.e., powder for image forming) from the corresponding toner container 32 to a developing device of the corresponding image forming unit 46.

As illustrated in FIG. 1, the printer body 100 includes an exposure device 47, serving as a latent image forming device, disposed below the four image forming units 46. The exposure device 47 exposes a surface of a drum-shaped photoconductor 41 according to image data read by the scanner 400 or that externally acquired by external devices such as computers, thereby forming an electrostatic latent image thereon. Although the exposure device 47 in the configuration illustrated in the drawing employs a laser beam scanning using a laser diode, the exposure device 47 is not limited to such a configuration. Alternatively, for example, a light-emitting diode (LED) array can be used.

Figure 2:
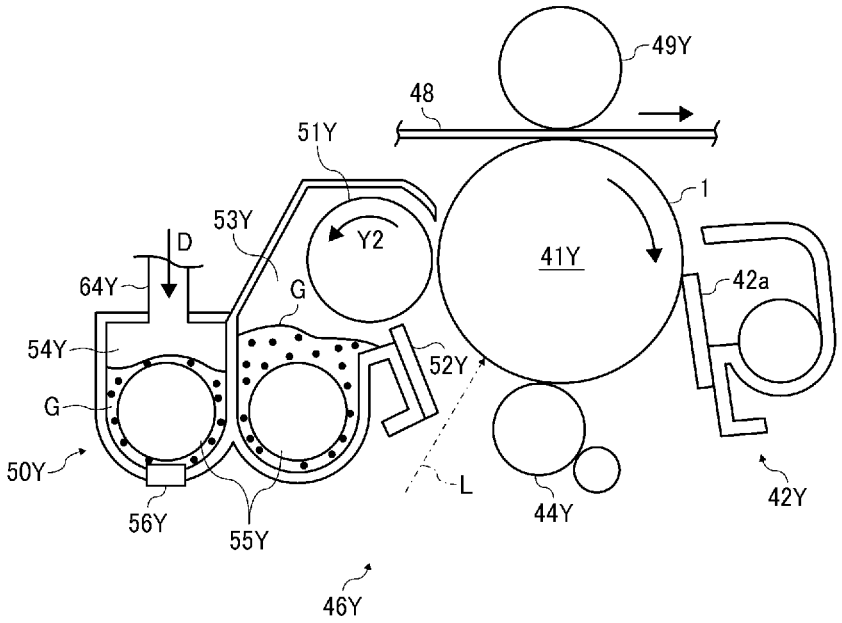
FIG. 2 is a schematic end-on axial view of an image forming device of the image forming apparatus illustrated in FIG. 1.

Structure of image forming section FIG. 2 is a schematic end-on axial view of the image forming unit 46Y for yellow.

The image forming unit 46Y includes the drum-shaped photoconductor 41Y serving as a latent image bearer. In the image forming unit 46Y, around the photoconductor 41Y, a charging roller 44Y serving as a charging device, a developing device 50Y, a photoconductor cleaning device 42Y to clean the photoconductor 41Y, and a discharger are disposed. Image forming processes, namely, charging, exposure, development, transfer, and cleaning processes are performed on the photoconductor 41Y, and thus a yellow toner image is formed on the photoconductor 41Y.

Note that other three image forming units 46M, 46C, and 46K have a similar configuration to that of the yellow image forming unit 46Y except the color of the toner used therein and form toner images of the respective colors on the photoconductors 41M, 41C, and 41K. Thus, only the image forming unit 46Y is described below and descriptions of other three image forming units 46M, 46C, and 46K are omitted.

The photoconductor 41Y rotates clockwise in FIG. 2, driven by a drive motor. The surface of the photoconductor 41Y is charged uniformly at a position opposite the charging roller 44Y by the charging roller 44Y (charging process). When the photoconductor 41Y reaches a position to receive a laser beam L emitted from an exposure device 47, the photoconductor 41Y is scanned with the laser beam L, and thus an electrostatic latent image for yellow is formed thereon (exposure process). Then, the photoconductor 41Y reaches a position opposite the developing device 50Y, where the electrostatic latent image is developed with toner into a yellow toner image (development process).

The four primary-transfer bias rollers 49 of the intermediate transfer unit 85 sandwich the intermediate transfer belt 48 with the corresponding photoconductors 41, respectively, forming primary transfer nips therebetween. To each primary-transfer bias roller 49, a transfer bias opposite in polarity to the toner is applied.

At the position opposite the primary-transfer bias roller 49Y via the intermediate transfer belt 48, the toner image is transferred from the photoconductor 41Y onto the intermediate transfer belt 48 in the primary transfer nip (primary transfer process). After the primary transfer process, a certain amount of toner tends to remain untransferred on the photoconductor 41Y. Subsequently, the surface of the photoconductor 41Y reaches a position opposite the photoconductor cleaning device 42Y, where a cleaning blade 42*a* mechanically scraps off the untransferred toner from the photoconductor 41Y (cleaning process). Subsequently, the discharger removes residual potentials from the surface of the photoconductor 41Y. Thus, a sequence of image forming processes performed on the photoconductor 41Y is completed.

The above-described image forming processes are performed also in the image forming units 46M, 46C, and 46K similarly. That is, the exposure device 47 disposed below the image forming units 46M. 46C, and 46K in FIG. 2 irradiates, with laser beams L according to image data, the photoconductors 41M, 41C, and 41K in the respective image forming units 46. Specifically, the exposure device 47 includes light sources to emit the laser beams L, multiple optical elements, and a polygon mirror that is rotated by a motor. The exposure device 47 directs the laser beams L to the respective photoconductors 41 via the multiple optical elements while deflecting the laser beams L with the polygon mirror. Then, the toner images are transferred from the respective photoconductors 41M, 41C, and 41K onto the intermediate transfer belt 48 and superimposed one on another thereon.

While rotating in the direction indicated by the arrow illustrated in FIG. 1, the intermediate transfer belt 48 sequentially passes through the respective primary transfer nips of the primary-transfer bias rollers 49Y, 49M, 49C, and 49K. Then, yellow, magenta, cyan, and black toner images are primarily transferred from the respective photoconductors 41Y, 41M, 41C, and 41K and superimposed one on another, into a multicolor toner, on the intermediate transfer belt 48.

Then, the intermediate transfer belt 48 carrying the multicolor toner image reaches a position opposite a secondary transfer roller 89 disposed opposite the secondary-transfer backup roller 82. The secondary-transfer backup roller 82 and the secondary transfer roller 89 press against each other via the intermediate transfer belt 48, and the contact portion therebetween is hereinafter referred to as a secondary transfer nip. The multicolor toner image on the intermediate transfer belt 48 is transferred onto a recording medium P such as a paper sheet transported to the secondary transfer nip. At this time, a certain amount of toner tends to remain untransferred on the intermediate transfer belt 48 after the secondary transfer process. The intermediate-transfer cleaning device collects untransferred toner remaining on the intermediate transfer belt 48, and thus a sequence of transfer processes performed on the intermediate transfer belt 48 is completed.

Next, conveyance of the recording medium P is described below.

The recording medium P is transported from a sheet feeding tray 26 of the sheet feeder 200 positioned below the printer body 100 to the secondary transfer nip via a feed roller 27 and a registration roller pair 28. More specifically, the sheet feeding tray 26 contains multiple recording media P piled one on another. The feed roller 27 rotates counterclockwise in FIG. 1 to feed the recording medium P on the top in the sheet feeding tray 26 toward a nip formed by the registration roller pair 28.

The registration roller pair 28 stops rotating temporarily, stopping the recording medium P with a leading end of the recording medium P stuck in the nip. The registration roller pair 28 resumes rotation to transport the recording medium P to the secondary transfer nip, timed to coincide with the arrival of the multicolor toner image formed on the intermediate transfer belt 48. Thus, the multicolor toner image is transferred onto the recording medium P.

Subsequently, the recording medium P is transported to a fixing device 86. In the fixing device 86, a fixing belt and a pressing roller apply heat and pressure to the recording medium P to fix the multicolor toner image on the recording medium P. Subsequently, the recording medium P is discharged by a sheet ejection roller pair 29 outside the apparatus and sequentially stacked as output images on a stack section 30. Thus, a sequence of image forming processes performed in the image forming apparatus 500 is completed.

Next, a configuration and operation of the developing device 50Y in the image forming unit 46Y are described in further detail below. Although the yellow image forming unit 46Y is described as a representative here, the image forming units 46 for other colors are similar in configuration to the image forming unit 46Y.

As illustrated in FIG. 2, the developing device 50Y includes a developing roller 51Y (a developer bearer), a doctor blade 52Y (a developer regulator), two developer conveying screws 55Y, a toner concentration sensor 56Y, and the like. The developing roller 51Y is disposed opposite the photoconductor 41Y, and the doctor blade 52Y faces the developing roller 51Y. The two developer conveying screws 55Y are disposed inside two developer containing compartments, namely, first and second developer containing compartments 53Y and 54Y. The developing roller 51Y includes a stationary magnet roller and a sleeve that rotates around the magnet roller. The first and second developer containing compartments 53Y and 54Y contain two-component developer G including carrier (carrier particles) and toner (toner particles). The second developer containing compartment 54Y communicates, via an opening on an upper side thereof, with a downward toner passage 64Y. The toner concentration sensor 56Y detects the concentration of toner in developer in the second developer containing compartment 54Y.

Inside the developing device 50Y, the developer G is agitated by the two developer conveying screws 55Y and circulated between the first and second developer containing compartments 53Y and 54Y. While being transported by the developer conveying screw 55Y, the developer G in the first developer containing compartment 53Y is attracted by magnetic fields generated by the magnet roller inside the developing roller 51Y and carried onto the sleeve surface of the developing roller 51Y. The developer G carried on the developing roller 51Y moves along the circumference of the developing roller 51Y as the sleeve of the developing roller 51Y rotates counterclockwise in FIG. 2 as indicated by arrow Y2. At that time, toner particles in developer G are charged through friction with carrier particles to have a potential in the polarity opposite the polarity of carrier particles. Then, the toner particles are electrostatically attracted to the carrier particles and carried on the developing roller 51Y together with the carrier particles by the magnetic field generated on the developing roller 51Y.

The developer G carried on the developing roller 51Y is transported as indicated by arrow in FIG. 2 to a position where the doctor blade 52Y faces the developing roller 51Y. Then, the amount of developer G on the developing roller 51Y is adjusted to a suitable amount by the doctor blade 52Y, after which the developer G is carried to a developing range opposite the photoconductor 41Y. In the developing range, the toner in developer G attracted to the latent image formed on the photoconductor 41Y due to the effect of a developing electrical field generated between the developing roller 51Y and the photoconductor 41Y. As the sleeve rotates, the developer G remaining on the developing roller 51Y reaches an upper part in the first developer containing compartment 53Y and then drops from the developing roller 51Y.

The percentage or concentration of toner in developer G contained in the developing device 50Y is adjusted within a predetermined range. Specifically, the toner supply device 60Y, described later, supplies the toner from the toner container 32Y to the second developer containing compartment 54Y according to the consumption of toner in the developing device 50Y.

The developer conveying screws 55Y stir the toner supplied to the developer containing compartment 54Y, together with the developer G, and circulate the toner between the first and second developer containing compartments 53Y and 54Y.

Toner supply device Descriptions are given below of the toner supply devices 60Y, 60M, 60C, and 60K.

Figure 3:
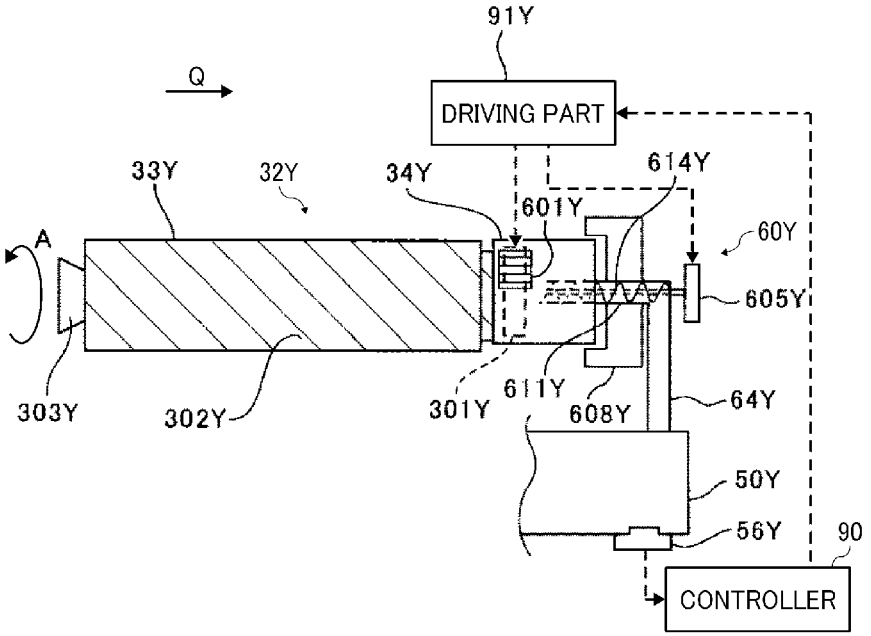
FIG. 3 is a schematic diagram illustrating a toner supply device of the image forming apparatus illustrated in FIG. 1 and a toner container mounted therein.
Figure 4:
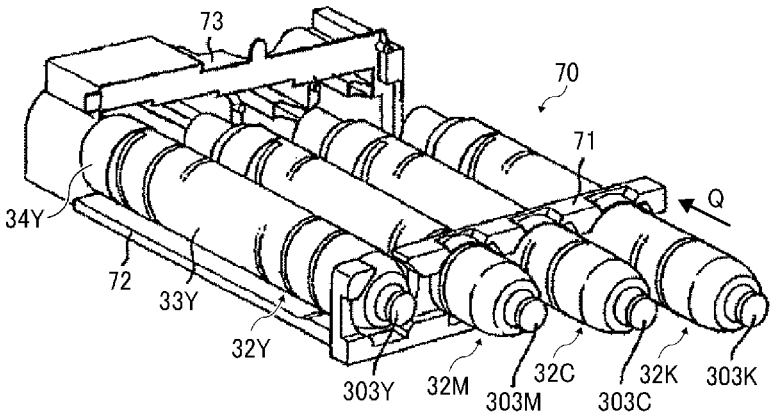
FIG. 4 is a perspective view of a toner container mount of the image forming apparatus illustrated in FIG. 1, in which the toner container is set.

FIG. 3 illustrates the toner supply device 60Y and the toner container 32Y mounted therein. FIG. 4 is a perspective view of the toner containers 32 mounted in the toner container mount 70.

The respective color toners contained in the toner containers 32Y, 32M, 32C, and 32K in the toner container mount 70 of the printer body 100 are supplied to the corresponding developing devices 50Y, 50M, 50C, and 50K according to the amount of the toner consumed. The toner supply devices 60Y, 60M, 60C, and 60K supply the respective color toners from the toner containers 32Y, 32M, 32C, and 32K to the developing devices 50Y, 50M, 50C, and 50K, respectively. The four toner supply devices 60 have a similar configuration, and the four toner containers 32 have a similar configuration, except the color of the toner used in the image forming processes. Therefore, the toner supply device 60Y and the toner container 32Y for yellow are described below as representatives, and descriptions of the toner supply devices 60M, 60C, and 60K and the toner containers 32M, 32C, and 32K for other three colors are omitted.

Each toner supply device 60 includes the toner container mount 70, a conveying nozzle 611 (e.g., 611Y), a conveying screw 614 (e.g., 614Y), the downward toner passage 64 (e.g., 64Y), and a driving part 91 (e.g., 91Y) to drive the toner container 32. In conjunction with insertion of the toner container 32Y into the toner container mount 70 of the printer body 100 in the direction indicated by arrow Q illustrated in FIG. 4 (hereinafter $B!H (Binstallation direction Q $B!I (B), the conveying nozzle 611Y of the toner supply device 60Y is inserted into the toner container 32Y from the front side of the toner container 32Y. With this action, an interior of the toner container 32Y communicates with the conveying nozzle 611Y. The structure relating to this action is described in detail later.

The toner container 32Y is, for example, a substantially tubular bottle. The toner container 32Y includes a container end cover 34Y held by the toner container mount 70 not to rotate and a container body 33Y formed integrally with a container gear 301Y. The container body 33Y is held to rotate relative to the container end cover 34. Note that the container gear 301Y can be produced separately from the container body 33Y to be removably attached to the container body 33Y.

The toner container mount 70 mainly includes a container cover receiving section 73, a container receiving section 72, and an insertion hole part 71. The container cover receiving section 73 holds the container end cover 34Y of the toner container 32Y, and the container receiving section 72 holds the container body 33Y. The insertion hole part 71, together with the container receiving section 72, defines an insertion opening into which the toner container 32Y is inserted. When a front cover of the image forming apparatus 500 (on the front side of the paper on which FIG. 1 is drawn) is opened, the insertion hole part 71 of the toner container mount 70 is exposed. The toner containers 32Y, 32M, 32C, and 32K are inserted and removed on the front side of the image forming apparatus 500 with the long axis of the toner containers 32 kept horizontal. Note that a socket 608Y illustrated in FIG. 3 is a portion of the container cover receiving section 73 of the toner container mount 70.

Herein, a longitudinal length of the container receiving section 72 is almost equal to the longitudinal length of the container body 33Y. The container cover receiving section 73 is located on one side (on the leading side in the direction of insertion) in the longitudinal direction of the container receiving section 72. The insertion hole part 71 is located on the other side (on the upstream side in the direction of insertion) of the container receiving section 72. Accordingly, in the insertion of the toner container 32Y into the toner container mount 70, the container end cover 34Y passes through the insertion hole part 71, slides on the container receiving section 72 for a certain distance, and is then attached to the container cover receiving section 73.

In a state in which the container end cover 34Y is attached to the container cover receiving section 73, a rotation driving force is input to the container gear 301Y of the container body 33Y, via a container drive gear 601Y, from the driving part 91Y including a drive motor and a drive gear. With the driving force, the container body 33Y rotates in the direction indicated by arrow A illustrated in FIG. 3 (hereinafter $B!H (Brotation direction A $B!I (B). The container body 33Y includes a spiral rib 302Y protruding inward from an inner face of the container body 33Y. As the container body 33Y rotates, the spiral rib 302Y conveys the toner in the container body 33Y from the container rear end to the container front end (from the left to the right in FIG. 3) in the longitudinal direction of the container body 33Y. Then, the toner is supplied from the container end cover 34Y into the conveying nozzle 611Y.

The conveying screw 614Y is disposed inside the conveying nozzle 611Y. When the driving part 91 inputs a driving force to a conveying screw gear 605Y, the conveying screw 614Y rotates, thus transporting toner inside the conveying nozzle 611Y. A downstream end of the conveying nozzle 611Y in the toner conveyance direction is connected to the downward toner passage 64Y. The toner conveyed by the conveying screw 614Y drops under the gravity through the downward toner passage 64Y and is supplied to the developing device 50Y, in particular, to the second developer containing compartment 54Y.

The toner containers 32 are replaced when the respective service lives thereof have expired, that is, when almost all toner in the toner container 32 have been consumed. A handle 303 is disposed at the end of the toner container 32 opposite the container end cover 34, and users can grasp the handle 303 to remove the toner container 32 from the image forming apparatus 500 in replacement.

Based on the image data used by the exposure device 47, a controller 90 can calculate the toner consumption and determine that supply of toner to the developing device 50Y is necessary. Alternatively, based on a detection result generated by the toner concentration sensor 56Y, the controller 90 can detect that the percentage of toner in the developing device 50Y has decreased. Then, the controller 90 drives the driving part 91Y to rotate the container body 33Y and the conveying screw 614Y of the toner container 32Y for a predetermined time period, thereby supplying the toner to the developing device 50Y. Since the conveying screw 614Y inside the conveying nozzle 611Y is rotated to supply toner, the amount of toner supplied from the toner container 32Y can be calculated accurately by detecting the number of rotation of the conveying screw 614Y. For example, the toner supply amount is accumulatively calculated from the installation of the toner container 32Y. When the toner supply amount reaches the amount of toner contained in the toner container 32Y at the time of installation, the controller 90 determines that the toner container 32Y is empty (a state referred to as $B!H (Btoner end $B!I (B) and causes a display of the image forming apparatus 500 to prompt the user to replace the toner container 32Y.

After the toner concentration sensor 56Y detects a decrease in the toner concentration, the toner supply action is performed, and the controller 90 determines whether or not the toner concentration has recovered. It is possible that the toner concentration sensor 56Y does not detect the recovery of toner concentration even after the toner supply action and toner concentration detection are repeatedly performed. In such a case, similarly, determining the toner container 32Y is empty, the controller 90 causes the display of the image forming apparatus 500 to prompt the user to replace the toner container 32Y.

In the toner supply device 60Y according to the present embodiment, the amount of toner supplied to the developing device 50Y is controlled with the rotation speed of the conveying screw 614Y. Accordingly, on the downstream side of the conveying nozzle 611Y in the toner supply direction, the mount of toner to be supplied to the developing device 50Y is not restricted, and the toner is conveyed through the downward toner passage 64 directly to the developing device 50Y. Alternatively, in the toner supply device 60Y in which the conveying nozzle 611Y is inserted into the toner container 32Y as in the present embodiment, a toner reservoir such as a toner hopper can be provided. Then, the amount of toner conveyed from the toner reservoir to the developing device 50Y can be adjusted to control the amount of toner supplied to the developing device 50Y. Although the conveying screw 614Y conveys the toner in the conveying nozzle 611Y in the toner supply device 60Y according to the present embodiment, the structure to convey the toner in the conveying nozzle 611Y is not limited to screws. For example, a powder pump can be used to generate a negative pressure at the nozzle opening of the conveying nozzle 611Y as described in Patent Document 4, to generate a conveyance force to the toner.

In configurations including the toner reservoir, typically a toner end sensor is provided to detect that the amount of toner remaining in the toner reservoir falls to or below a threshold. According to the detection by the toner end sensor, the container body 33Y and the conveying screw 614Y are rotated for a predetermined period to supply toner to the toner reservoir. If the toner end sensor continues to report $B!H (Btoner end $B!I (B even when this operation is repeated a predetermined number of times, the controller 90 causes the display of the image forming apparatus 500 to prompt users to replace the toner container 32Y, determining that the toner container 32Y is empty. Cumulative calculation of supplied toner from the installation of the toner container 32Y is not required in the configuration in which whether toner is left inside the toner container 32Y is determined based on the detection by the toner end sensor. However, the configuration without the toner reservoir, such as the toner supply device 60Y according to the present embodiment, is advantageous in that the toner supply device 60Y can be compact, thereby reducing the size of the entire image forming apparatus 500.

Toner container and toner supply device Next, the toner container 32 and the toner supply device 60 are described in further detail. As described above, the four toner containers 32 and the four toner supply devices 60 have similar configurations except the color of toner contained therein, and the suffixes Y, M, C, and K are omitted when color discrimination is not necessary.

Figure 5:
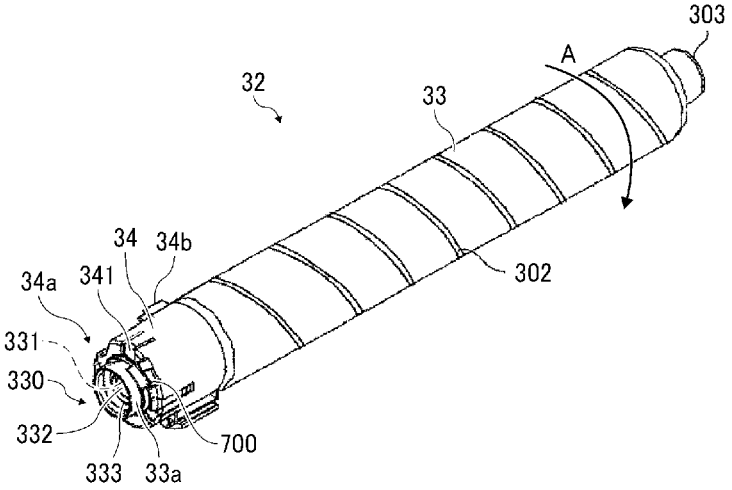
FIG. 5 is a perspective view of a toner container according to an embodiment.
Figure 6:
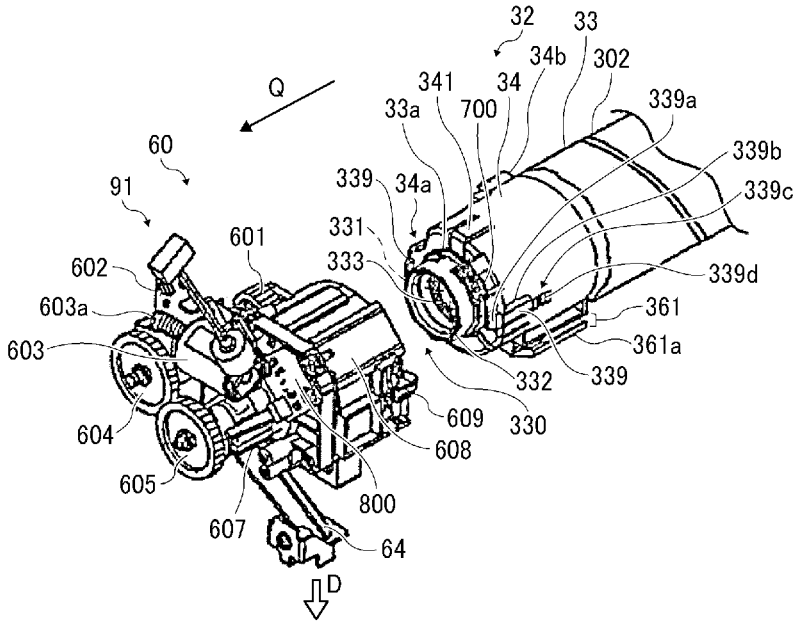
FIG. 6 is a perspective view of the toner container illustrated in FIG. 5 in a state before the toner container is attached to the toner supply device.
Figure 7:
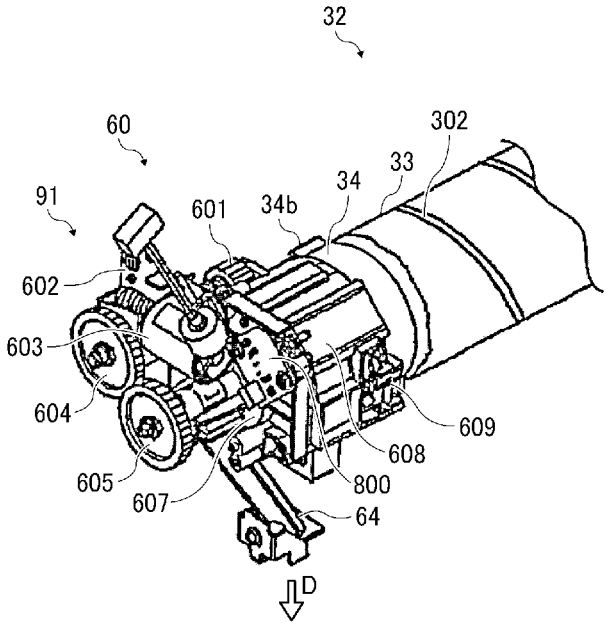
FIG. 7 is a perspective view of the toner container illustrated in FIG. 5 being attached to the toner supply device.
Figure 8:
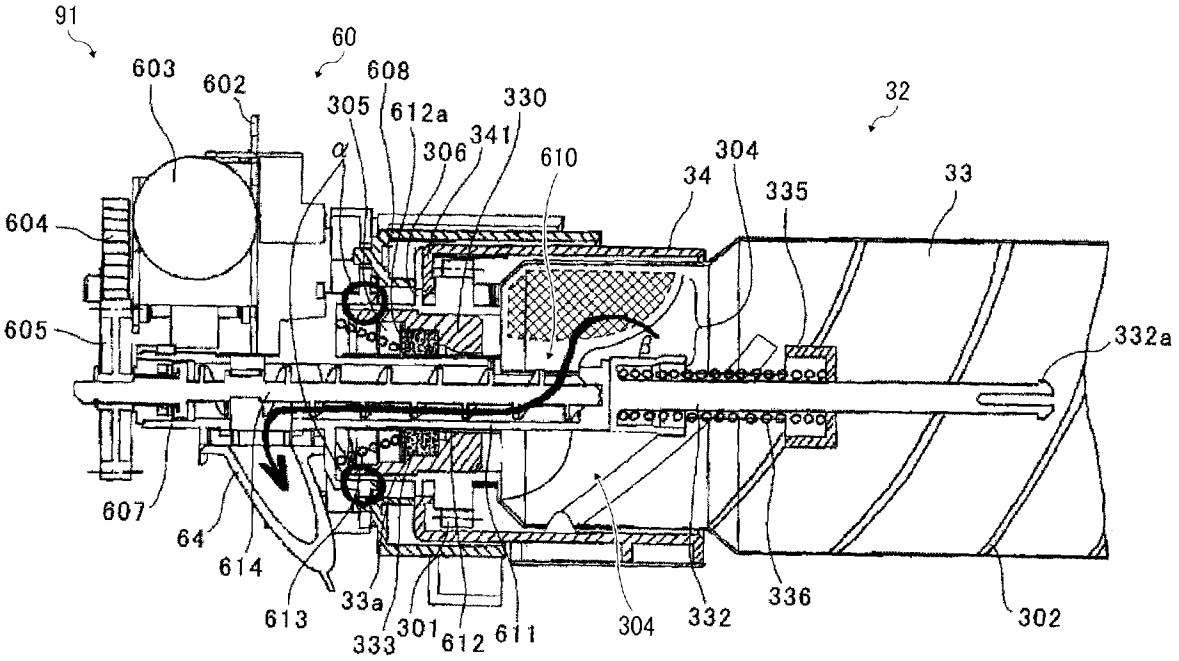
FIG. 8 is a cross-sectional view of the toner container illustrated in FIG. 7, being attached to the toner supply device.

FIG. 5 is a perspective view of the toner container 32. FIG. 6 is a perspective view of the front end portion of the toner container 32 and the toner supply device 60 before the toner container 32 is attached thereto. FIG. 7 is a perspective view of the toner supply device 60 and the front end portion of the toner container 32 attached thereto. FIG. 8 is a cross-sectional view of the toner supply device 60 and the front end portion of the toner container 32 attached thereto.

As illustrated in FIG. 8, the toner supply device 60 includes the conveying nozzle 611 in which the conveying screw 614 is disposed and a nozzle shutter 612. In the state illustrated in FIG. 6 in which the toner container 32 is not mounted in the toner supply device 60, the nozzle shutter 612 closes a nozzle hole 610 formed in the conveying nozzle 611. When the toner container 32 is mounted in the toner supply device 60 as illustrated in FIGS. 7 and 8, the nozzle shutter 612 opens the nozzle hole 610. In a center area of the front end face of the toner container 32, a nozzle connecting opening 331 for receiving the conveying nozzle 611 is formed as illustrated in FIGS. 5 and 6. A container shutter 332 is provided to close the nozzle connecting opening 331 when the conveying nozzle 611 is not connected thereto. The front end portion of the container body 33 includes a nozzle receiver 330 defining the nozzle connecting opening 331.

The toner container 32 is described below.

As described above, the toner container 32 includes the container body 33 and the container end cover 34.

Figure 9:
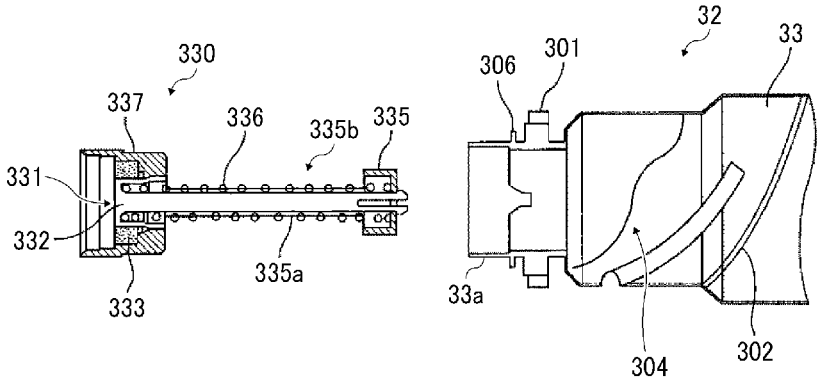
FIG. 9 is a cross-sectional view of a container body of the toner container illustrated in FIG. 8 and a nozzle receiver removed therefrom.
Figure 10:
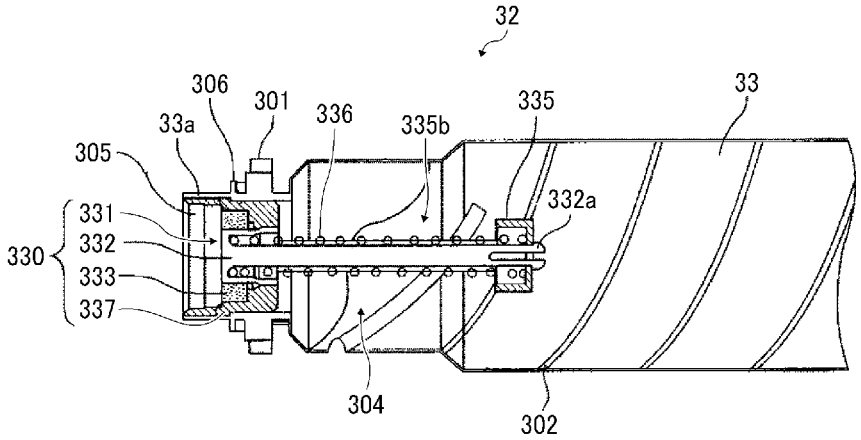
FIG. 10 is a cross-sectional view of a state in which the nozzle receiver is attached to the container body from the state illustrated in FIG. 9.

FIG. 9 is a cross-sectional view of the toner container 32 and the nozzle receiver 330 removed from the container body 33. FIG. 10 is a cross-sectional view of the toner container 32 in a state in which the nozzle receiver 330 is attached to the container body 33 from the state illustrated in FIG. 9. FIG. 10 illustrates the toner container 32 without the container end cover 34 illustrated in FIG. 5. In the state without the container end cover 34, the toner container 32 is constructed of the container body 33 and the nozzle receiver 330 defining the nozzle connecting opening 331.

The container body 33 is substantially cylindrical and rotatable around a center axis of the cylindrical shape (i.e., rotation axis). Hereinafter, a direction parallel to the rotation axis of the container body 33 is referred to as $B!H (B axial direction $B!I (B. In the axial direction, the end side of the toner container 32 including the nozzle connecting opening 331 (on which the container end cover 34 is disposed) is referred to as $B!H (Bfront side $B!I (B. The end side of the toner container 32 in which the handle 303 is disposed is referred to as $B!H (Bcontainer rear side $B!I (B (opposite the container front side). Additionally, $B!H (Bfront side $B!I (B and $B!H (Brear side $B!I (B of components of the toner container 32 respectively correspond to $B!H (Bcontainer front side $B!I (B and $B!H (Bcontainer rear side $B!I (B unless otherwise specified. Note that the longitudinal direction of the toner container 32 is the axial direction thereof, and the axial direction is kept horizontal when the toner container 32 is mounted in the toner supply device 60. A portion (i.e., a large diameter portion) of the container body 33 closer to the container rear end than (upstream in the installation direction Q from) the container gear 301 is larger in external diameter than the front end portion of the container body 33, and the spiral rib 302 is disposed on the inner face of the large diameter portion. As the container body 33 rotates in the direction A illustrated in FIG. 5, the spiral rib 302 gives a conveyance force to the toner in the container body 33 in the direction from one side to the other side in the axial direction (from the container rear side to the container front side).

The front end portion of the container body 33 includes a scooping portion 304 to lift (scoop) the toner being transported to the container front side by the spiral rib 302 as the container body 33 rotates in the direction A. The scooping portion 304 is raised toward the axis of the container body 33 to reduce an inner diameter of the container body 33. As the container body 33 rotates, the scooping portion 304 scoops up the toner entering a space facing the scooping portion 304, conveyed by the conveyance force of the spiral rib 302. Thus, the toner can be lifted higher than the conveying nozzle 611 (see FIG. 8) inserted into the container body 33. The scooping portion 304 is described later in further detail.

The container gear 301 is closer to the container front end than the scooping portion 304 in the container body 33. In the structure illustrated in FIG. 5, the container end cover 34 is party cut away, providing a gear exposing window 34*a*, to partly expose the container gear 301 (on the back side in FIG. 5) in a state in which the container end cover 34 is attached to the container body 33. When the toner container 32 is mounted in the toner supply device 60, the container gear 301 exposed through the gear exposing window 34*a* meshes with the container drive gear 601 of the toner supply device 60.

The container body 33 includes a cylindrical bottle mouth 33*a* positioned closer to the front end of the container body 33 than (downstream in the attachment direction Q1 from) the container gear 301. A receiver securing ring 337 is press-fitted in the bottle mouth 33*a* to secure the nozzle receiver 330 to the container body 33. The method to secure the nozzle receiver 330 is not limited to press fit. Alternatively, the nozzle receiver 330 can be glued or screwed to the container body 33, for example.

After toner is put from the bottle mouth 33*a* (the opening enclosed thereby) into the container body 33, the nozzle receiver 330 is secured to the bottle mouth 33*a* of the container body 33.

At an end of the bottle mouth 33*a* of the container body 33 closer to the container gear 301, a cover hook catch 306 is disposed. To the toner container 32 (the container body 33 in particular) being in the state illustrated in FIG. 9, the container end cover 34 (illustrated in FIG. 6) is attached from the front side (on the left in FIG. 9). Then, the container body 33 penetrates the container end cover 34 in the axial direction, and a cover hook 341 disposed in an upper portion of the container end cover 34 is hooked to the cover hook catch 306. The cover hook catch 306 extends over the entire circumference of the bottle mouth 33*a*. With the cover hook 341 retained by the cover hook catch 306, the container body 33 can rotate relative to the container end cover 34. Note that the cover hook catch 306 can be produced separately from the container body 33 to be removably attached to the container body 33.

For example, the container body 33 is manufactured through blow molding (such as biaxial stretch blow molding and direct blow molding). The container body 33 illustrated in FIG. 9 is manufactured by biaxial stretch blow molding.

Typically, biaxial stretch blow molding (disclosed in Patent Documents 1 to 3) includes two steps of preform molding and stretch blow molding. In the preform molding step, resin is injected into a preform (a parison having a closed bottom) shaped like a test tube. During the step of injection molding, the bottle mouth 33*a*, the cover hook catch 306, and the container gear 301 are formed at a mouth of the tube-shaped preform. After the step of preform molding, the preform is cooled, removed from the mold, and heated (softened). Then, blow molding and stretch of the softened preform are executed (stretch blow molding).

The portion of the container body 33 closer to container rear end than the container gear 301 is formed in the step of stretch blow molding. That is, the portion where the scooping portion 304 and the spiral rib 302 are formed, and the handle 303 are formed by stretch blow molding.

The shape of the front end portion of the container body 33 including the container gear 301, the bottle mouth 33*a*, and the cover hook catch 306, positioned closer to the container front end than the container gear 301 are not changed from the preform produced by injection molding. Accordingly, dimensional accuracy can be high. By contrast, the portion including the handle 303, the scooping portion 304, and the spiral rib 302, which is formed by stretch blow molding after injection molding, may be lower in dimensional accuracy than the preform portion.

Direct blow molding is described later.

Next, the nozzle receiver 330 secured to the container body 33 is described below.

Figure 11:
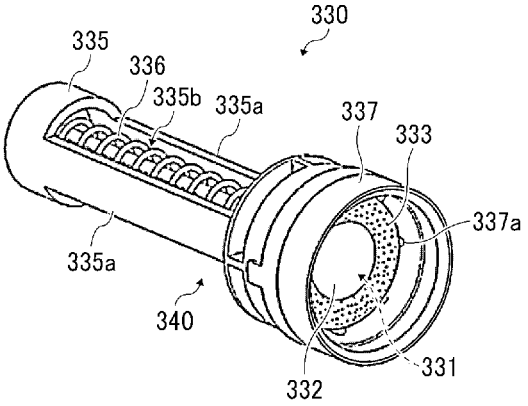
FIG. 11 is a perspective view of the nozzle receiver as viewed from a container front side.
Figure 12:
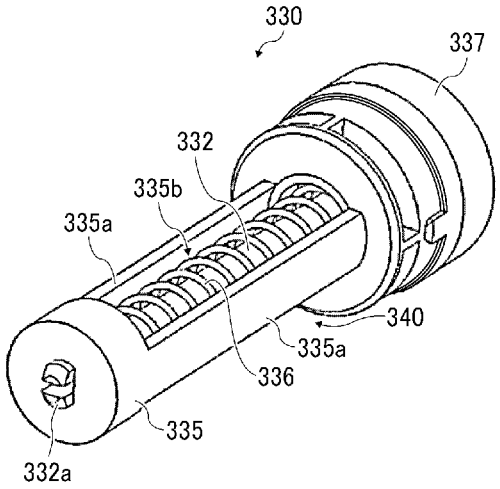
FIG. 12 is a perspective view of the nozzle receiver as viewed from a container rear side.
Figure 13:
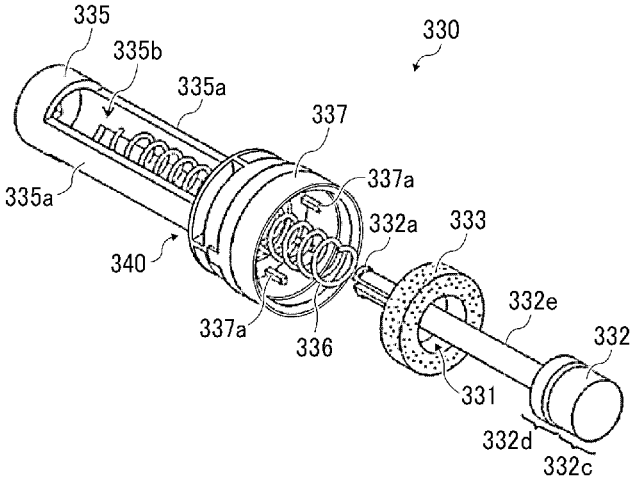
FIG. 13 is an exploded perspective view of the nozzle receiver.

FIG. 11 is a perspective view of the nozzle receiver 330 as viewed from the container front side. FIG. 12 is a perspective view of the nozzle receiver 330 as viewed from the container rear side. FIG. 13 is an exploded perspective view of the nozzle receiver 330.

The nozzle receiver 330 includes a container shutter supporter 340, the container shutter 332, a container seal 333, and a container shutter spring 336. The container shutter supporter 340 includes a rear end support 335, a pair of shutter side supports 335*a*, and the receiver securing ring 337. The container shutter spring 336 is, for example, a coil spring.

The container shutter 332 includes a cylindrical end part 332*c*, a slide portion 332*d*, a guide rod 332*e*, and a pair of shutter retaining hooks 332*a*. The cylindrical end part 332*c* is a container front end portion to tightly contact a cylindrical mouth (the nozzle connecting opening 331) of the container seal 333. The slide portion 332*d* is closer to the container rear end than the cylindrical end part 332*c* and slightly larger in diameter than the cylindrical end part 332*c*. The slide portion 332*d* is a cylindrical portion that slides on an inner face of the pair of shutter side supports 335*a*. The guide rod 332*e* is a column standing (rooted) inside the cylindrical end part 332*c* toward the container rear end. The guide rod 332*e* is a rod inserted into the coil of the container shutter spring 336 to guide the container shutter spring 336 not to buckle. The pair of shutter retaining hooks 332*a* is disposed at an end of the guide rod 332*e* opposite the rooted end. The pair of shutter retaining hooks 332*a* prevents the container shutter 332 from slipping off the container shutter supporter 340.

Since the container shutter spring 336 is inserted between the cylindrical end part 332*c* and the rear end support 335 in a compressed state, the container shutter 332 is urged away from the rear end support 335 (toward the container front end). However, the shutter retaining hooks 332*a* at the rear end of the container shutter 332 are hooked on an outer wall of the rear end support 335. Thus, the container shutter 332 is inhibited from moving away from the rear end support 335. Positioning is made by the engagement between shutter retaining hooks 332*a* and the rear end support 335 as well as the bias force exerted by the container shutter spring 336. Specifically, the cylindrical end part 332*c*, which inhibits leak of toner from the container shutter 332, and the container seal 333 are aligned in the axial direction relative to the container shutter supporter 340. With this alignment, leak of toner is prevented.

As illustrated in FIGS. 11 through 13, the pair of shutter side supports 335*a* facing each other is located closer to the container rear end than the receiver securing ring 337. The shutter side supports 335*a* are shaped like halves of a cylinder cut in the axial direction. Ends of the two side supports 335*a* on the container rear side are coupled to the rear end support 335 shaped like a cup having a bottom with an oval hole. As the two side support 335*a* face each other, a columnar space is defined by the cylindrical inner faces of the shutter side support 335*a* and a face of a virtual cylinder extending therefrom. The slide portion 332*d* of the container shutter 332 slidingly moves in the columnar space.

As illustrated in FIGS. 11 through 13, on the inner face of the receiver securing ring 337, multiple contact ribs 337*a* (i.e., nozzle shutter positioning ribs) are disposed in a radiation arrangement. The contact ribs 337*a* are adjacent to the periphery of the container seal 333. As illustrated in FIG. 8, when the toner container 32 is attached to the toner supply device 60, a nozzle shutter spring 613 biases a nozzle shutter flange 612*a* of the nozzle shutter 612 of the toner supply device 60, and the nozzle shutter flange 612*a* compresses a projecting portion of the container seal 333. As the toner container 32 is inserted further, the nozzle shutter flange 612*a* covers the front end face of the container seal 333 (pressed to ends of the contact ribs 337*a*) on the container front side than the nozzle connecting opening 331. Then, the container seal 333 is shielded from the outside of the toner container 32. Thus, sealing around the conveying nozzle 611 in the nozzle connecting opening 331 can be secured at the time of installation, preventing toner leak.

As the rear side (opposite the face to receive the nozzle shutter spring 613) of the nozzle shutter flange 612*a* being biased by the nozzle shutter spring 613 contacts the contact ribs 337*a*, the position of the nozzle shutter 612 is determined relative to the toner container 32 in the axial direction. Thus, the positions of the front end face of the container seal 333 and the front end face of a front opening 305 (see FIG. 10) relative to the nozzle shutter 612 in the axial direction are determined. The front opening 305 is a space inside the cylindrical receiver securing ring 337 disposed in the bottle mouth 33*a*.

In a state in which the nozzle shutter flange 612*a* is in contact with the contact ribs 337*a*, the nozzle hole 610 in the conveying nozzle 611 is positioned sufficiently inside the toner container 32 (on the container rear side) from the entrance of the nozzle connecting opening 331. Specifically, in the axial direction, the nozzle hole 610 is closer to the container rear side than the container gear 301 and faces the scooping portion 304 in the state in which the nozzle shutter flange 612*a* is in contact with the contact ribs 337*a*.

The two shutter side supports 335*a* facing each other are shaped to form a cylinder shape that is cut away largely at two positions, and shutter supporter slots 335*b* (see FIGS. 11 through 13) are formed. Owing to this shape, the container shutter supporter 340 can guide the container shutter 332 to move in the axial direction, in a columnar space defined inside the shutter side supports 335*a*.

The nozzle receiver 330 secured to the container body 33 rotates as the container body 33 rotates. At that time, the shutter side supports 335*a* of the nozzle receiver 330 rotate around the conveying nozzle 611 of the toner supply device 60. While rotating, the shutter side supports 335*a* pass a position close to and above the nozzle hole 610 located in the upper portion of the conveying nozzle 611. If the toner momentarily accumulates above the nozzle hole 610, the shutter side supports 335*a* cross and break the accumulation of toner. This structure inhibits aggregation of toner while the apparatus is left unused and inhibits poor conveyance of toner at restart of the apparatus. By contrast, when the two shutter side supports 335*a* are positioned on the lateral sides of the conveying nozzle 611 and the nozzle hole 610 faces the shutter supporter slot 335*b*, the toner is supplied from the container body 33 to the conveying nozzle 611 as indicated by arrow $B&B (B illustrated in FIG. 8.

As illustrated in FIG. 10, the inner face of the bottle mouth 33*a* of the container body 33 conforms to the contour of the receiver securing ring 337 and has a step to reduce the inner diameter of a rear portion of the bottle mouth 33*a*. A step of the outer face of the receiver securing ring 337 contacts the step of the inner face of the bottle mouth 33*a* over the entire circumference. This structure inhibits deviation of axis of the nozzle receiver 330 relative to the container body 33, meaning inclination of the center axis of the cylindrical receiver securing ring 337 relative to the center axis of the cylindrical bottle mouth 33*a*.

Figure 14:
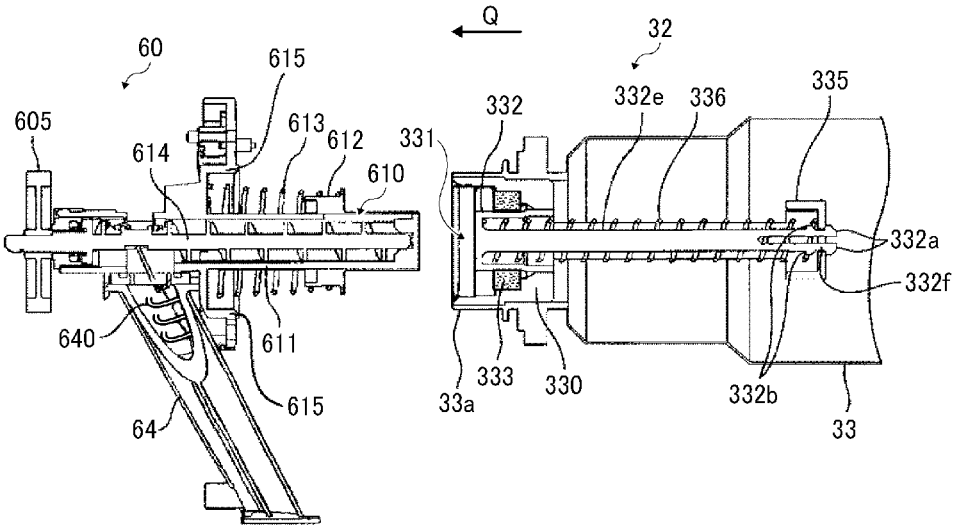
FIG. 14 is a cross-sectional view of the toner supply device and the front end portion of the toner container illustrated in FIG. 8, to be attached thereto.
Figure 15:
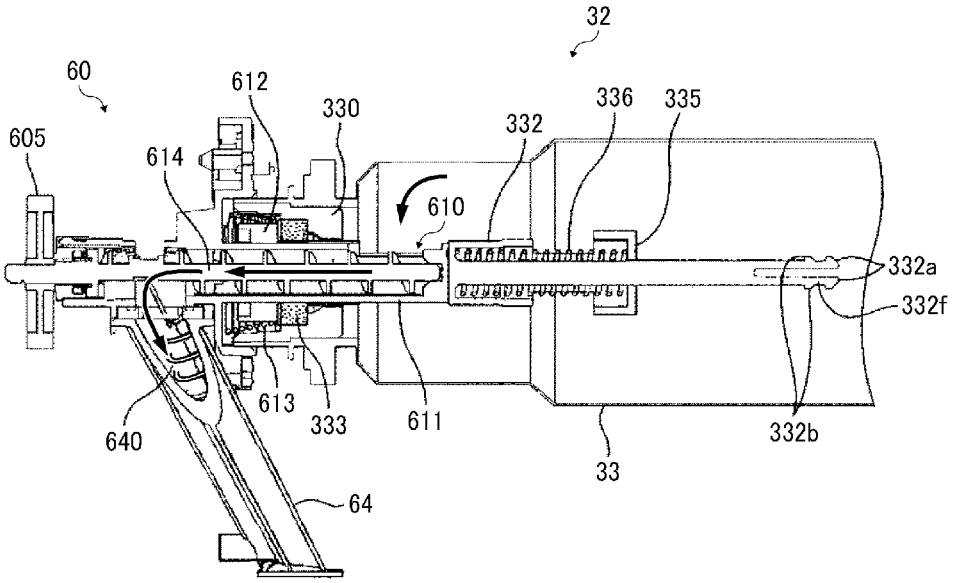
FIG. 15 is a cross-sectional view of the toner supply device and the front end portion of the toner container illustrated in FIG. 8, attached thereto.

FIG. 14 is a cross-sectional view of the toner supply device 60 and the front end portion of the toner container 32 not attached to the toner supply device 60. FIG. 15 is a cross-sectional view of the toner supply device 60 and the front end portion of the toner container 32 attached thereto.

In the structure illustrated in FIGS. 14 and 15, the container shutter spring 336 presses the container shutter 332 of the toner container 32 in the direction to close the nozzle connecting opening 331 (to the left in FIG. 14). The guide rod 332*e* includes two pairs of hook-shaped claws to prevent the container shutter 332 from slipping off. That is, the pair of shutter retaining hooks 332*a* and a pair of second shutter retaining hooks 332*b* are disposed at the end of the guide rod 332*e* on the container rear end. The rear end of the guide rod 332*e* is bifurcated into a pair of cantilevers 332*f*. The shutter retaining hook 332*a* and the second shutter retaining hook 332*b* are disposed on the outer face of each cantilever 332*f*. As illustrated in FIG. 14, in a state in which the container shutter 332 closes the nozzle connecting opening 331, a vertical face of the rear end support 335 is positioned between the shutter retaining hooks 332*a* and the second shutter retaining hooks 332*b*. The vertical face of the rear end support 335 has a hole smaller than the area of projection of the shutter retaining hooks 332*a* in the axial direction. The guide rod 332*e* is inserted into the container shutter spring 336, and the pair of cantilevers 332*f* of the guide rod 332*e* is deformed toward the center of the guide rod 332*e*. Then, the shutter retaining hooks 332*a* are inserted into the hole in the vertical face of the rear end support 335. Thus, the guide rod 332*e* is attached to the nozzle receiver 330 as illustrated in FIG. 14. The guide rod 332*e* is made of resin such as polystyrene to give the cantilevers 332*f* elasticity to deform.

FIG. 14 illustrates a state before the toner container 32 is set in the toner supply device 60 (e.g., unused state or state at the shipment).

To set the toner container 32 in the toner supply device 60 from the state illustrated in FIG. 14, the toner container 32 is pushed into the device body, and the end of the conveying nozzle 611 pushes the container shutter 332 into the toner container 32. At that time, the shutter retaining hooks 332*a* at the end of the guide rod 332*e* are pushed to the rear end of the rear end support 335. Then, the second shutter retaining hooks 332*b* are hooked in the hole in the vertical face of the rear end support 335.

Since the hole in the vertical face is smaller than the area of projection of the second shutter retaining hook 332*b* in the axial direction, the second shutter retaining hook 332*b* is not disengaged from the vertical face at the time of contact therebetween. When the user increases the strength of force pushing the toner container 32, however, a pushing force acts on the contact portion between the second shutter retaining hook 332*b* and the vertical face. Due to the pushing force, both of the cantilevers 332*f*, which have the second shutter retaining hooks 332*b* on the outer faces thereof, are deformed toward the center of the guide rod 332*e* so that the second shutter retaining hooks 332*b* penetrate the hole in the vertical face. Then, as illustrated in FIG. 15, the second shutter retaining hooks 332*b* are positioned closer to the rear end of the toner container 32 than the rear end support 335.

Once the toner container 32 is thus set, the second shutter retaining hooks 332*b* prevent the container shutter 332 from slipping off the toner container 32.

There is a risk that the toner container 32 falls during transport of the toner container 32 (in a state not installed in the apparatus) or setting in the apparatus by users. In such a case, an inertia force thereof may act on the container shutter 332 in the direction to open the container shutter 332. In the structure including the second shutter retaining hooks 332*b* as illustrated in FIGS. 14 and 15, when the toner container 32 falls, toner scattering can be prevented as follows. When the container shutter 332 is about to move in the direction to open, the container shutter 332 is prevented from moving in the direction to open by the container shutter spring 336 and the second shutter retaining hooks 332*b* hooked on the hole (a force to deform the cantilevers 332*f* is necessary for the second shutter retaining hooks 332*b* to pass through the hole). Differently from the pushing fore exerted by the user, the inertia force by the impact at the time of fall does not increase. Accordingly, the second shutter retaining hooks 332*b* are hooked in the hole in the vertical face of the rear end support 335 to inhibit the container shutter 332 from opening. Therefore, toner scattering at the fall of the toner container 32 can be prevented.

In the toner container 32 having the structure illustrated in FIGS. 14 and 15, without increasing the pressing force of the container shutter spring 336, the container shutter 332 can be prevented from moving upon impact of the fall of the toner container 32. Accordingly, toner scattering at the fall of the toner container 32 can be prevented without the above-described adverse effect. The toner scattering is prevented by adding the second shutter retaining hooks 332*b* to the container shutter 332 in the structure described with reference to FIG. 8 and the like without addition of another component. This effect is attained at a low cost.

Next, the container end cover 34 is described below with reference to FIGS. 4 through 7.

To mount the toner container 32 in the toner supply device 60, the container end cover 34 is moved slidingly on the container receiving section 72 illustrated in FIG. 4. In FIG. 4, directly below the four toner containers 32, grooves extend from the insertion hole part 71 to the container cover receiving section 73, and the long side of the grooves coincides with the axial direction of the container body 33. Referring to FIG. 6, a pair of slide guides 361 is disposed on both lateral sides of a lower portion of the container end cover 34 to enable the sliding in the groove. Specifically, a pair of slide rails projects from the both sides of the groove of the container receiving section 72. A slide guide 361 includes a slide groove 361*a* so as to be sandwiched by the pair of slide rails from above and below. The slide groove 361*a* is parallel to the rotation axis of the container body 33. The container end cover 34 further includes a container lock 339 to engage a device-side lock 609 disposed in the socket 608 when the container end cover 34 is attached to the toner supply device 60.

Additionally, as illustrated in FIG. 5, an identification (ID) tag 700 (e.g., an ID chip) is disposed on the container end cover 34 for recording data such as usage conditions of the toner container 32. The container end cover 34 further includes color discrimination ribs 34*b* to prevent the toner container 32 of the wrong color from being inserted into the socket 608. As described above, in installation of the toner container 32, as the slide guides 361 engages the slide rail of the container receiving section 72, the posture of the container end cover 34 on the toner supply device 60 is determined. Then, the alignment between the container lock 339 and the device-side lock 609 and the alignment between the ID tag 700 and a connector 800 described below are performed smoothly.

Next, the toner supply device 60 is described below in further detail.

As illustrated in FIGS. 6 and 7, the toner supply device 60 includes a nozzle holder 607 to secure the conveying nozzle 611 to a frame 602 of the printer body 100 of the image forming apparatus 500. The socket 608 is secured to the nozzle holder 607. To the nozzle holder 607, the downward toner passage 64 to communicate, from below, with the interior of the conveying nozzle 611 is secured.

Although not included in the structure illustrated in FIGS. 6 and 7, a movable spring 640 can be disposed in the downward toner passage 64 as in the structure illustrated in FIGS. 14 and 15.

An end of the movable spring 640 is attached to the rotation shaft of the conveying screw 614 so that the movable spring 640 moves up and down as the conveying screw 614 rotates. While moving up and down, the movable spring 640 scrapes off stagnant toner adjacent to and adhering to the inner face of the downward toner passage 64, which is, for example, a tube. To enhance the effect to prevent clogging of the downward toner passage 64, preferably the movable spring 640 to move up and down is close to the inner face of the downward toner passage 64. Since the downward toner passage 64 is cylindrical in the present embodiment, the movable spring 640 is used to scrape off the stagnant toner. The movable spring 640 has a diameter slightly smaller than the inner diameter of the downward toner passage 64. Alternatively, in a structure in which the downward toner passage 64 has a cross section (perpendicular to the axial direction thereof) that is not circular, preferably a spring having a shape conforming to the cross sectional shape of the downward toner passage 64 is used.

The driving part 91 is secured to the frame 602. The driving part 91 includes a drive motor 603 and the container drive gear 601. To a rotation shaft of the container drive gear 601, a worm gear 603*a* is attached for transmission of rotation of the drive motor 603. A drive transmission gear 604 is secured to the rotation shaft of the container drive gear 601 to mesh with the conveying screw gear 605 secured to the rotation shaft of the conveying screw 614. In this configuration, rotation of the drive motor 603 is transmitted via the container drive gear 601 and the container gear 301 (in FIG. 9) to the toner container 32, thereby rotating the toner container 32. Further, as the toner container 32 rotates, the conveying screw 614 is rotated via the drive transmission gear 604 and the conveying screw gear 605.

Alternatively, a clutch can be provided in a drive transmission route from the drive motor 603 to the container gear 301 or a drive transmission route from the drive motor 603 to the conveying screw gear 605. When such a clutch is provided, only one of the toner container 32 and the conveying screw 614 can be driven as the drive motor 603 rotates.

Installation of toner container Next, installation of the toner container 32 in the toner supply device 60 is described below with reference to FIGS. 8, 14, and 15.

When the toner container 32 is moved toward the toner supply device 60 as indicated by arrow Q illustrated, for example, in FIG. 14, an end of the conveying nozzle 611 contacts the front end face of the container shutter 332 on the container front side. When the toner container 32 is moved further toward the toner supply device 60, the conveying nozzle 611 presses the front end face of the container shutter 332. As the container shutter 332 is pressed, the container shutter spring 336 is compressed. Accordingly, the container shutter 332 is pushed inside the toner container 32 (to the container rear side), and the end of the conveying nozzle 611 is inserted into the nozzle connecting opening 331.

As the toner container 32 moves further toward the toner supply device 60, the rear face of the nozzle shutter flange 612*a*, opposite the face to receive the nozzle shutter spring 613, contacts the front end face of the container seal 333. Further, the nozzle shutter flange 612*a* squashes a little the container seal 333 and contacts the contact ribs 337*a* (see FIGS. 11 and 13). Then, the position of the nozzle shutter 612 relative to the toner container 32 in the axial direction is determined.

As the toner container 32 moves further toward the toner supply device 60, the conveying nozzle 611 is inserted further into the toner container 32. At that time, the nozzle shutter 612 being in contact with the contact ribs 337*a* is pushed back, relative to the conveying nozzle 611, to the base side of the conveying nozzle 611 (downstream side in the installation direction Q). With this movement, the nozzle shutter spring 613 is compressed, and the nozzle shutter 612 moves to the base side of the conveying nozzle 611 relative to the conveying nozzle 611. With this relative movement, the nozzle hole 610 is released from the nozzle shutter 612 and exposed inside the container body 33. Thus, the conveying nozzle 611 communicates with the interior of the container body 33.

When the conveying nozzle 611 is retained in the nozzle connecting opening 331, the container shutter spring 336 and the nozzle shutter spring 613, which are compressed, exert force to push back the toner container 32 relative to the toner supply device 60 (in the direction reverse to the installation direction Q). However, when the toner container 32 is inserted into the toner supply device 60, the toner container 32 is moved in the installation direction Q, against the push-back force, to the position where the container lock 339 engages the device-side lock 609 (see FIG. 6). Then, the container shutter spring 336 and the nozzle shutter spring 613 exert biasing force, and the device-side lock 609 engages the container lock 339. Due to the biasing force and the effect of engagement, the position of the toner container 32 relative to the toner supply device 60 in the axial direction is determined in the state illustrated in FIGS. 7 and 8.

As illustrated in FIG. 6, the container lock 339 includes two lock sets, each of which includes a guide projection 339*a*, a guide groove 339*b*, an overstridden portion 339*c*, and a tetragonal retaining hole 339*d*. One lock set is disposed on both sides of the container end cover 34 at axisymmetric positions relative to a vertical line penetrating the nozzle connecting opening 331. The guide projection 339*a* is disposed on a vertical face of the container end cover 34 on the front side and on a horizontal line penetrating the center of the nozzle connecting opening 331. The guide projection 339*a* includes an inclined face continuous with the guide groove 339*b* to cause the device-side lock 609 to contact the inclined face and to be guided toward the guide groove 339*b* when the toner container 32 is installed. The guide groove 339*b* is recessed from (one step lower than) the side face of the container end cover 34.

The width of the guide groove 339*b* is slightly greater than the width of the device-side lock 609 to such a degree that the device-side lock 609 is not disengaged from the guide groove 339*b*.

The container rear side of the guide groove 339*b* is not directly connected to the retaining hole 339*d*. The container rear end of the guide groove 339*b* has an end and equal in height to the side face of the container end cover 34. In other words, between the guide groove 339*b* and the retaining hole 339*d*, the face of the container end cover 34 extends about 1 mm and serves as the overstridden portion 339*c*. The device-side lock 609 overstrides the overstridden portion 339*c* and falls in the retaining hole 339*d*, and the toner container 32 is set in the toner supply device 60.

On a virtual plane perpendicular to the axis of the toner container 32, the container shutter 332 is positioned at a center of a segment connecting together the two container locks 339. If the container shutter 332 is not positioned on the segment connecting the two container locks 339, the following phenomenon may occur. The distance from the segment to the container shutter 332 becomes a lever, and a moment of force to rotate the toner container 32 around the segment is caused by the biasing force exerted at the position of the container shutter 332 by the container shutter spring 336 and the nozzle shutter spring 613. It is possible that the toner container 32 is inclined relative to the toner supply device 60 due to the moment. Then, the load in installing the toner container 32 increase to apply load to the nozzle receiver 330 that supports and guides the container shutter 332.

In particular, in a state in which the toner container 32 is new and filled to capacity with toner, when the toner container 32 is pushed into the toner supply device 60 so that the conveying nozzle 611 projecting horizontally is inserted thereinto, a moment of force to rotate the toner container 32 including the weight of toner acts. Accordingly, load is applied to the nozzle receiver 330 into which the conveying nozzle 611 is inserted, and the nozzle receiver 330 may be deformed or broken. By contrast, in the toner container 32 according to the present embodiment, the container shutter 332 is positioned on the segment connecting together the two container locks 339. This configuration can protect the toner container 32 from tilting relative to the toner supply device 60 due to the bias force exerted at the position of the container shutter 332 by the container shutter spring 336 and the nozzle shutter spring 613.

In a state in which alignment of the toner container 32 in the axial direction is made, the outer face of the bottle mouth 33*a* slidingly fits in the inner face of the container setting section 615 (FIG. 14). Accordingly, the position of the toner container 32 relative to the toner supply device 60 is determined in a plane direction perpendicular to the axial direction. Thus, installation of the toner container 32 in the toner supply device 60 is completed.

After the toner container 32 is installed, as the drive motor 603 rotates, the container body 33 and the conveying screw 614 in the conveying nozzle 611 are rotated.

As the container body 33 rotates, the toner therein is transported by the spiral rib 302 to the container front side. When the toner reaches the scooping portion 304, the scooping portion 304 lifts the toner to a position above the nozzle hole 610 as the container body 33 rotates. The toner then falls to the nozzle hole 610 and is supplied into the conveying nozzle 611. The toner is transported inside the conveying nozzle 611 by the conveying screw 614 and supplied to the developing device 50 through the downward toner passage 64 as indicated by arrow D in FIG. 6. Note that the flow of toner from the container body 33 to the downward toner passage 64 is indicated by arrow $B&B (B illustrated in FIG. 8.

Descriptions are given below of engagement between the toner container 32 and the container setting section 615 (illustrated in FIG. 14) and the adjacent structure. In portions $B&A (B illustrated in FIG. 8, the bottle mouth 33*a* slidingly contacts the container setting section 615 and the position of the toner container 32 relative to the toner supply device 60 is determined as described above. Note that, although the portions $B&A (B in FIG. 8 have both capabilities of sliding contact and positioning, alternatively, the positions $B&A (B can have one of capabilities of sliding contact and positioning.

The toner container 32 according to the present embodiment includes the nozzle receiver 330 that is disposed at the opening of the container body 33 and defines the nozzle connecting opening 331 and the shutter supporter slot 335*b*. To the nozzle connecting opening 331, the conveying nozzle 611 including the nozzle hole 610 (a powder inlet) is inserted. From the shutter supporter slot 335*b* (a toner supply opening), the toner contained in the container body 33 is supplied to the nozzle hole 610. The toner container 32 further includes the container shutter 332 supported by the nozzle receiver 330. As the conveying nozzle 611 is inserted into and pulled out from the nozzle receiver 330, the container shutter 332 slides in the axial direction to open and close the nozzle connecting opening 331. With this configuration, in the toner container 32, the nozzle connecting opening 331 is kept closed until the conveying nozzle 611 is inserted therein. Thus, before the toner container 32 is mounted in the toner supply device 60, leak and scattering of toner can be prevented.

When the conveying nozzle 611 is inserted into the nozzle connecting opening 331, the container shutter 332 slides to the rear side, pushed by the conveying nozzle 611. Then, toner accumulating around the shutter supporter slot 335*b* is pushed away. Thus, space for the portion of the conveying nozzle 611 in which the nozzle hole 610 is formed to enter can be secured around the shutter supporter slot 335*b*, and toner can be supplied reliably from the shutter supporter slot 335*b* to the nozzle hole 610.

Thus, leak or scattering of toner from the toner container 32 being removed from the toner supply device 60 can be prevented, while discharge of toner from the toner container 32 (container body 33) being mounted in the toner supply device 60 can be secured.

In the toner container 32, as illustrated in FIG. 10, the nozzle connecting opening 331 is closer to the container rear end than the front end of the front opening 305. That is, the nozzle connecting opening 331 is disposed deeper in the toner container 32 than the front end of the cylindrical receiver securing ring 337 defining the opening of the container body 33.

This arrangement can inhibit the toner from adhering to the outer face of the bottle mouth 33*a*. When the conveying nozzle 611 is pulled out from the toner container 32, even if the toner leaks, the toner leaking from the nozzle connecting opening 331 is less likely to go around the front end of the bottle mouth 33*a*. Additionally, the toner dropping from the nozzle connecting opening 331 is caught on an inner face of the toner container 32 lower than the front opening 305, thereby preventing the toner from adhering to the inner face of the container setting section 615. Thus, the toner leaking from the nozzle connecting opening 331 is kept in the space enclosed by the inner face located deeper in the toner container 32 than the front end face of the bottle mouth 33*a*, and scattering of toner outside the toner container 32 is inhibited.

The container shutter 332 to seal the nozzle connecting opening 331, through which toner is discharged from the toner container 32, is positioned closer to the container rear end (deeper) than the front end of the receiver securing ring 337 defining the front opening 305 of the container body 33. In other words, a certain distance is secured from the container shutter 332 to the front end of the front opening 305. This arrangement inhibits the toner at the nozzle connecting opening 331 (located deeper in the container body 33 than the opening of the container body 33) from going around the opening of the container body 33 and reaching the outer face of the bottle mouth 33*a*. Thus, scattering of toner is inhibited.

As the outer face of the bottle mouth 33*a* fits in the cylindrical container setting section 615, the position of the toner container 32 relative to the toner supply device 60 in the direction perpendicular to the axial direction is determined. That is, the outer face of the bottle mouth 33*a* of the container body 33 (a powder storage) performs the positioning of the container body 33 relative to the toner supply device 60 (powder conveyance device). Therefore, if the outer face of the bottle mouth 33*a* is soiled with toner, the contact state with the container setting section 615 is changed, and the positioning accuracy may be degraded. By contrast, since the toner container 32 according to the present embodiment is designed to inhibit toner from reaching and adhering to the outer face of the bottle mouth 33*a*, the positioning accuracy of the toner container 32 relative to the toner supply device 60 is stable.

When the toner container 32 rotates, the outer face of the bottle mouth 33*a* and the inner face of the container setting section 615 slide on each other. In other words, the outer face of the bottle mouth 33*a* of the container body 33 (the powder storage) is a sliding portion that slidingly contacts the toner supply device 60 (the powder conveyance device). If toner enters the sliding portion, it is possible that sliding load increases and the rotation torque of the toner container 32 increases. By contrast, the toner container 32 according to the present embodiment can inhibit the toner from reaching the outer face of the bottle mouth 33*a* and inhibit toner from entering the contact portion with the container setting section 615. Accordingly, increases in sliding load are inhibited to stabilize the sliding, and increases in rotation torque of the toner container 32 can be inhibited. Additionally, with toner inhibited from entering the sliding portion, aggregation of toner in the sliding portion can be inhibited. As described above, when the toner container 32 is attached to the toner supply device 60, the nozzle shutter flange 612*a* compresses the container seal 333 and coheres the container seal 333 with pressure. Thus, prevention of toner leak is secured. Since the container shutter 332 is disposed deeper in the toner container 32 (closer to the container rear end) than the opening (front end) of the toner container 32, a cylindrical space is provided between the front end of the toner container 32 and the front end faces of the container shutter 332 and the container seal 333.

Embodiment 1 A toner container according to Embodiment 1 is described below.

Figure 16A:
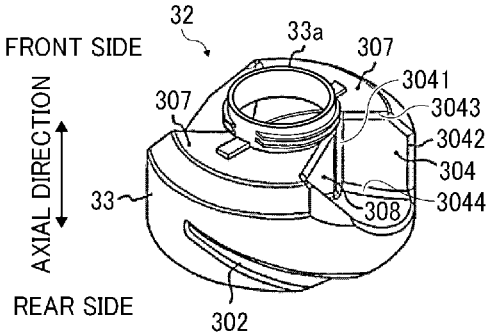
FIG. 16A is a perspective view of a front side of a toner container according to Embodiment 1.
Figure 16B:
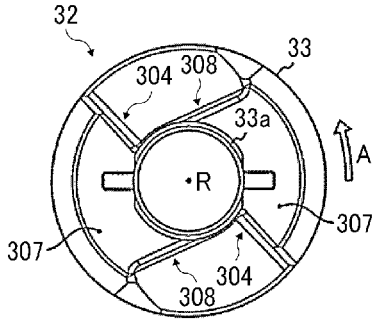
FIG. 16B is an end-on axial view as viewed from a bottle mouth of the toner container according to Embodiment 1.
Figure 16C:
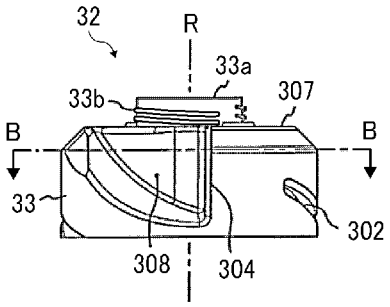
FIG. 16C is a side view of the front side of the toner container according to Embodiment 1.

FIG. 16A is a perspective view, FIG. 16B is an end-on axial view as viewed from the bottle mouth 33*a*, and FIG. 16C is a side view of the front side of the toner container 32 according to Embodiment 1. In Embodiment 1, the toner container 32 includes a radially inner face 308 extending from the bottle mouth 33*a* to the container rear end and located farther from the center of the toner container 32 than the rim of the container opening in the radial direction. Hereinafter the terms $B!H (Bradially $B!I (B and $B!H (Bradial direction $B!I (B relate to the radial direction or radial direction of the container body 33. With this shape, differences in the drawn amount of the parison around the mouth of the toner container are smaller. Then, the amount of resin used to manufacture the toner container is reduced, and the weight of the toner container is reduced.

The toner container 32 (the powder container) includes the substantially cylindrical container body 33 to contain toner (powder) and rotate around the axis, for example, a rotation axis R illustrated in FIG. 16C in a horizontal posture. The toner container 32 further includes the substantially cylindrical bottle mouth 33*a* disposed at one end of the container body 33 in the axial direction and smaller in inner diameter than the container body 33. The toner container 32 further includes the spiral rib 302 (a conveyor) disposed on (e.g., projecting from) the inner face of the container body 33 to convey the powder toward to one end in the axial direction, in particular, toward the bottle mouth 33*a* (container front side) as the container body 33 rotates. The container body 33 includes the scooping portion 304 (a scooping face) disposed deeper in the container body 33 (closer to the container rear end in the axial direction) than the bottle mouth 33*a*. The scooping portion 304 scoops the toner conveyed by the spiral rib 302 as the container body 33 rotates. The scooping portion 304 scoops the toner to a position above the nozzle hole 610 (powder inlet) of the conveying nozzle 611 (a conveying tube) inserted from the bottle mouth 33*a* and drops the toner to the nozzle hole 610. The container body 33 further includes the radially inner face 308 continuous with an inner end of the scooping portion 304 in the radial direction of the container body 33. The radially inner face 308 extends in a direction crossing the scooping portion 304 and closer to the rotation center of the container body 33 than an outermost face of the container body 33 in the radial direction of the container body 33. The axial is the rotation axis of the container body 33, and, in the present embodiment, the rotation axis is identical to the center axis of the substantially cylindrical container body 33. The horizontal posture includes a state in which the rotation axis is horizontal and a state in which the rotation axis is oblique to the horizontal direction to a degree that the spiral rib 302 can convey the toner.

In the toner container 32 illustrated in FIGS. 16A to 16C, the container gear 301 and the cover hook catch 306 illustrated in FIG. 9 are discrete from the container body 33. In this case, the container gear 301 and the cover hook catch 306 are attached to the container body 33 into a single component with a female screw thread 33*b* on the outer face of the bottle mouth 33*a*.

As described above, the container body 33 is manufactured through blow molding (such as biaxial stretch blow molding and direct blow molding). The container body 33 illustrated in FIGS. 16A to 16C is manufactured through direct blow molding.

In direct blow molding, initially a thermoplastic resin is fused with heat and extruded into a tubular parison. The parison being a softened state is sandwiched with a mold for blow molding, cooled to solidify, and removed from the mold. In direct blow molding, the scooping portion 304, the portion where and the spiral rib 302 is disposed, and the handle 303 are formed. The container gear 301 and the portions closer to the container front side than the container gear 301, which require high accuracy in dimensions, are formed through, for example, injection molding, and then attached (e.g., screwed) to the components formed through direct blow molding.

Scooping portion As the container body 33 rotates in the rotation direction A illustrated in the drawings, the spiral rib 302 conveys the toner to the container front side, and the scooping portion 304 scoops the toner conveyed by the spiral rib 302 to a position above the nozzle hole 610.

The scooping portion 304 is a face extending in a direction crossing the rotation direction A of the container body 33. The scooping portion 304 includes a radially inner end 3041, a radially outer end 3042, a front end 3043, and a rear end 3044. The radially inner end 3041 extends from the bottle mouth 33*a* along the axial direction toward the container rear end. The radially outer end 3042 is an outer end of the scooping portion 304 in the radial direction of the container body 33 and extends from a shoulder top 307 (a top face) or a position adjacent thereto in the axial direction toward the container rear end. The front end 3043 connects the front end of the radially inner end 3041 to the front end of the radially outer end 3042. The rear end 3044 connects the rear end of the radially inner end 3041 to the rear end of the radially outer end 3042.

The shoulder top 307 is a front end face in the axial direction of the container body 33. Although the shoulder top 307 is almost perpendicular to the axial direction in the example illustrated in FIGS. 16A to 16C, alternatively, the shoulder top 307 can extend toward the container rear side obliquely to the axial direction.

The radially inner face 308 is a face including a portion extending from the inner rim of the bottle mouth 33*a* toward the container rear end in the axial direction. As illustrated in FIG. 16B, the radially inner face 308 is not inner in the radial direction of the container body 33 than a virtual cylinder extending from the inner rim of the bottle mouth 33*a* parallel to the axial direction. Although the radially inner face 308 is parallel to the axial direction in the structure illustrated in FIGS. 16A to 16C, alternatively, the radially inner face 308 can be oblique thereto to draw away from the center axis of the container body 33 from the container front side toward the container rear side.

The toner container 32 in the present embodiment is a blow-molded container. In the present embodiment, the radially inner face 308 is not closer to the center in the radial direction of the container body 33 than the bottle mouth 33*a* so that the toner container 32 does not has a significant constriction. Accordingly, during molding, a significant difference in thickness is less likely to occur between a bottle shoulder (adjacent to the front end 3043) and another portion of the container body 33. Accordingly, even when the parison for the toner container 32 is relatively thin entirely, the minimum thickness standard for toner containers is satisfied, and the amount of resin used and the weight of the toner container can be reduced.

Figure 17A:
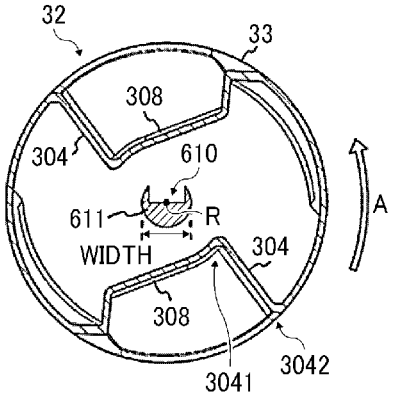
FIG. 17A is a schematic view of the scooping portion scooping and dropping toner according to Embodiment 1.
Figure 17B:
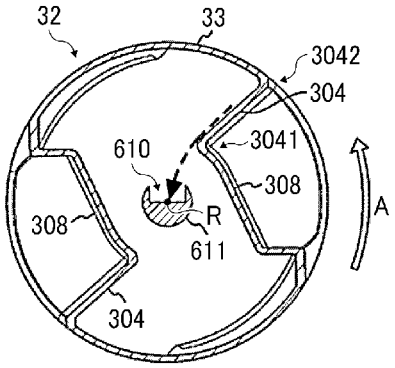
FIG. 17B is a schematic view of the scooping portion scooping and dropping toner according to Embodiment 1.

Scooping of toner by scooping portion FIGS. 17A and 17B are schematic views illustrating the scooping portion 304 scooping and dropping toner T. FIGS. 17A and 17B are cross-sectional views, along line B-B in FIG. 16C, of the front end side of the container body 33.

As the container body 33 rotates in the rotation direction A, the scooping portion 304 temporarily holds the toner and lifts the toner above the nozzle hole 610. Further, the scooping portion 304 drops the scooped toner from the radially inner end 3041 toward the nozzle hole 610 as the container body 33 rotates.

The nozzle hole 610 extends on both sides of the rotation axis of the toner container 32 and has a predetermined length in the width direction of the toner container 32 and a predetermined length in the axial direction (in the direction penetrating the paper on which FIG. 17A is drawn). The width of the nozzle hole 610 is the length thereof in the direction perpendicular to the rotation axis. In the axial direction of the toner container 32, the position of the scooping portion 304 is almost identical to the position of the nozzle hole 610 (the scooping portion 304 opposes the nozzle hole 610).

The inclination of the scooping portion 304 relative to the nozzle hole 610 is set as follows. When the angle of the scooping portion 304 is at an angle of repose of the toner, an extended face (extended line) extending from an upper face of the scooping portion 304 toward the rotation axis R (or the nozzle hole 610) is located between a farther end of the nozzle hole 610 (farther from the scooping portion 304 in the width direction) and a center of the nozzle hole 610 in the width direction (directly above the rotation axis R). In the case of the scooping portion 304 on the right in FIG. 17B, $B!H (Bfarther end of the nozzle hole 610 $B!I (B is the left end of the nozzle hole 610 in FIG. 17B.

With this setting, the scooping portion 304 can efficiently supply, to the nozzle hole 610, the toner discharged at a relatively high speed from the scooping portion 304, falling in a linear trajectory following the inclination of the scooping portion 304. While the container body 33 rotates, the scooping portion 304 rises and approaches the nozzle hole 610 in the width direction. Accordingly, the scooping portion 304 can efficiently supply, to the nozzle hole 610, even such toner T that is discharged from the scooping portion 304 at a lower speed and falls along a trajectory shaper than the inclination of the scooping portion 304.

Note that the inclination of the scooping portion 304 relative to the nozzle hole 610 is set in accordance with properties of toner to be contained in the toner container 32.

Figure 18A:
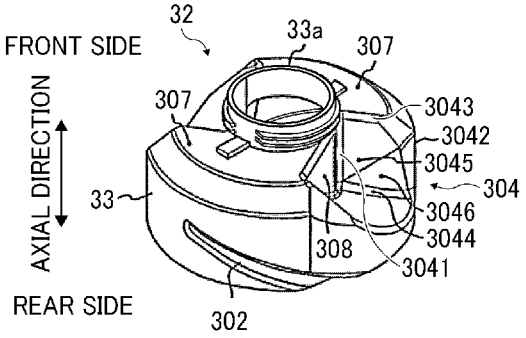
FIG. 18A is a perspective view of a front side of a toner container according to Embodiment 2.
Figure 18B:
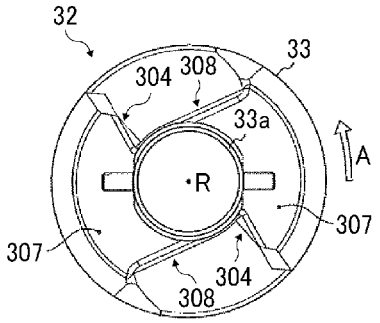
FIG. 18B is an end-on axial view as viewed from a bottle mouth of the toner container according to Embodiment 2.
Figure 18C:
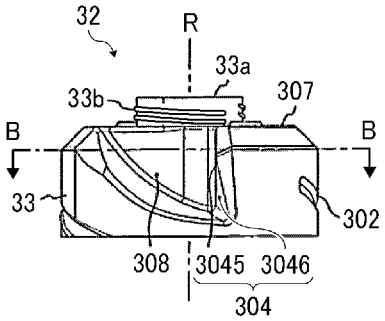
FIG. 18C is a side view of the front side of the toner container according to Embodiment 2.

Embodiment 2 A toner container according to Embodiment 2 is described below. FIG. 18A is a perspective view, FIG. 18B is an end-on axial view as viewed from a bottle mouth, and FIG. 18C is a side view of a front side of the toner container according to Embodiment 2. In the toner container 32 according to Embodiment 2, the scooping portion 304 has a shape recessed to the upstream side in the rotation direction A. Note that elements similar to those of Embodiment 1 are given identical or similar reference characters, and descriptions thereof are simplified.

The scooping portion 304 includes a supply face 3045 (a supply portion) including the radially inner end 3041 and disposed on the container front side. The scooping portion 304 further includes a conveying face 3046 (a conveying portion) including the rear end 3044. The conveying face 3046 conveys the toner to the supply face 3045. The supply face 3045 guides the toner from the radially inner end 3041 to the nozzle hole 610.

The supply face 3045 is substantially parallel to the rotation axis R and becomes horizontal when the toner container 32 is at a horizontal position. A front side of the conveying face 3046 is adjacent to the supply face 3045. The conveying face 3046 is inclined such that, when the supply face 3045 is horizontal, the front side of the conveying face 3046 is lower than a rear side thereof. The supply face 3045 is connected to the conveying face 3046 at an angle smaller than 180 degrees to be recessed to the upstream side in the rotation direction A. More specifically, the angle between the supply face 3045 and the conveying face 3046 is obtuse.

The scooping portion 304 according to the present embodiment is constructed of two planar portions, namely, the supply face 3045 and the conveying face 3046. Alternatively, the scooping portion 304 can includes three or more faces. Yet alternatively, the scooping portion 304 can include a curved face.

The toner scooped by the scooping portion 304 drops from the supply face 3045 and enters the nozzle hole 610, guided by the radially inner end 3041.

Figure 19:
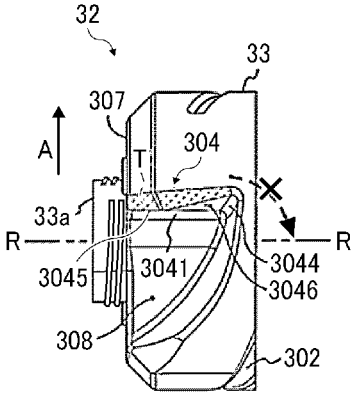
FIG. 19 is a side view of the scooping portion according to Embodiment 2.

The shape of the scooping portion 304 is described with reference to FIG. 19. As illustrated in FIG. 19, the scooping portion 304 is shaped like a pocket recessed to the upstream side in the rotation direction A. This shape enhances the capability of the scooping portion 304 to hold the toner. Additionally, the conveying face 3046 is inclined to descend to the supply face 3045 when the toner container 32 is set in the toner supply device 60. Accordingly, as the container body 33 rotates, the toner on the conveying face 3046 moves toward the supply face 3045. Additionally, the conveying face 3046 is inclined so that the rear side thereof is higher than the front side thereof. This shape inhibits the toner on the conveying face 3046 from moving beyond the rear end 3044 to fall. Thus, the capability of the scooping portion 304 to hold the toner improves.

Figure 20A:
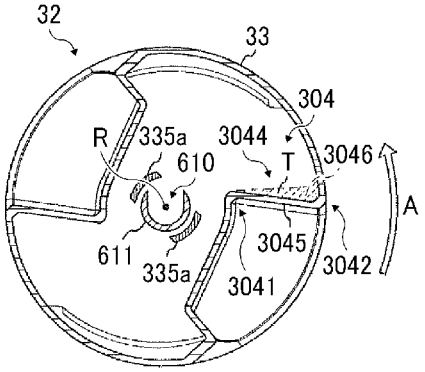
FIG. 20A is a schematic view of the scooping portion scooping and dropping toner according to Embodiment 2.
Figure 20B:
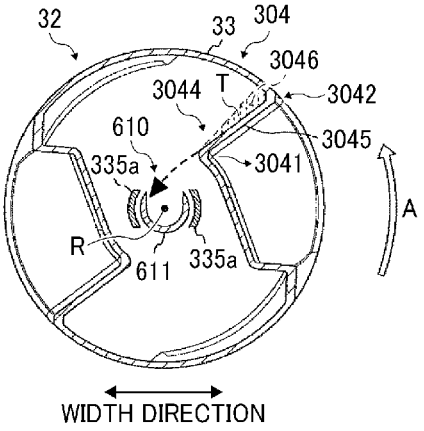
FIG. 20B is a schematic view of the scooping portion scooping and dropping toner according to Embodiment 2.
Figure 20C:
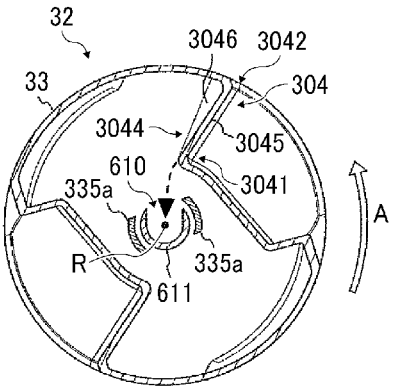
FIG. 20C is a schematic view of the scooping portion scooping and dropping toner according to Embodiment 2.

Scooping of toner by scooping portion FIGS. 20A, 20B, and 20C are schematic views illustrating the scooping portion 304 scooping and dropping toner T. FIGS. 20A, 20B, and 20C are cross-sectional views, along line B-B in FIG. 18C, of the front end side of the container body 33.

As illustrated in FIG. 20A, while the container body 33 rotates in the rotation direction A, the scooping portion 304 scoops and temporarily holds the toner T. FIG. 20A illustrates a state as if the toner T on the scooping portion 304 is leveled off. In other words, in FIG. 20A, both of the radially inner end 3041 and the rear end 3044 of the scooping portion 304 are horizontal, and the surface of the toner T held on the scooping portion 304 is horizontally leveled off at the heights of the radially inner end 3041 and the rear end 3044. The scooping portion 304 is shaped such that the amount of toner T held on the scooping portion 304 in the leveled-off state is greater than the specified toner supply amount (the amount of toner supplied per second).

Note that the toner T on the scooping portion 304 is retained by the supply face 3045 and the conveying face 3046 of the scooping portion 304 and a portion of the shoulder top 307 adjoining the supply face 3045 (see FIG. 19).

As illustrated in FIG. 20A, when the toner T scooped by the scooping portion 304 is at the angle of repose, the toner T falls from the radially inner end 3041 toward the nozzle hole 610, drawing a parabola-like trajectory.

Further, as illustrated in FIG. 20C, as the container body 33 rotates, the toner T retained in the scooping portion 304 is sequentially conveyed by the conveying face 3046 toward the supply face 3045 and falls to the nozzle hole 610. In the present embodiment, the scooping portion 304 includes the supply face 3045 and the conveying face 3046. Since the conveying face 3046 reaches the angle of repose earlier, the toner can be retained efficiently until the supply face 3045 reaches the angle of repose.

Angle of scooping portion The angle of the scooping portion 304 is set as follows. When the inclination of the conveying face 3046 (or the supply face 3045) of the scooping portion 304 is equal to the angle of repose of the toner, an extended face (extended line) extending from the conveying face 3046 (or the supply face 3045) toward the rotation axis R is located between the farther end of the nozzle hole 610 (farther from the scooping portion 304) and the center in the width direction of the nozzle hole 610 (a width position corresponding to the rotation axis R).

With this setting, the scooping portion 304 can efficiently supply, to the nozzle hole 610, the toner discharged at a relatively high speed from the scooping portion 304, falling in a linear trajectory following the inclination of the scooping portion 304. While the container body 33 rotates, the scooping portion 304 rises and approaches the nozzle hole 610 in the width direction. Accordingly, the scooping portion 304 can efficiently supply, to the nozzle hole 610, even such toner that is discharged from the scooping portion 304 at a lower speed and falls along a trajectory shaper than the inclination of the scooping portion 304.

That is, the toner scooped by the scooping portion 304 moves inward in the radial direction of the container body 33 as the container body 33 rotates. In a state in which a relatively large amount of toner is held in the scooping portion 304, due to the relation between the weight of toner in the scooping portion 304 and the distance by which the toner slips down, the speed of discharge of toner tends to be fast, and the toner falls in the linear trajectory along the inclination of the scooping portion 304. By contrast, when the amount of toner in the scooping portion 304 is small and the weight of toner is light, the speed of discharge of toner from the scooping portion 304 is slower. Accordingly, a speed component in the direction of gravity increases, and the toner falls to the nozzle hole 610 in a trajectory shaper than the inclination of the scooping portion 304.

According to the present embodiment, the toner T is efficiently supplied to the nozzle hole 610 in accordance with the falling speed thereof.

Figure 21:
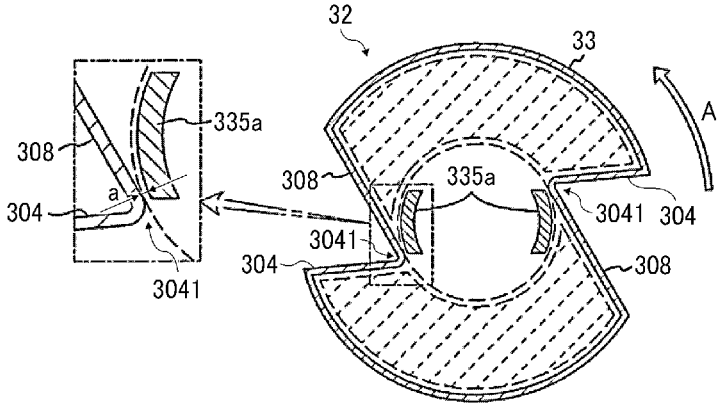
FIG. 21 is a cross-sectional view illustrating an adjacent area of a scooping portion of a toner container according to Embodiment 3.
Figure 22:
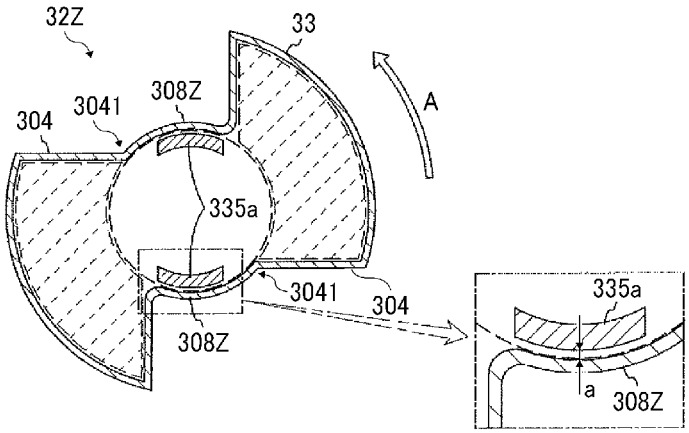
FIG. 22 is a cross-sectional view illustrating an adjacent area of a scooping portion of a toner container according to a comparative example.

Embodiment 3 In Embodiment 3, to secure a relatively wide space inside the toner container 32, a portion that approaches the shutter side support 335*a* of the nozzle receiver 330 (see FIG. 11) is restricted to the radially inner end 3041 of the scooping portion 304. FIG. 21 is a cross-sectional view illustrating an adjacent area of the scooping portion 304 of the toner container 32 according to Embodiment 3. FIG. 22 is a cross-sectional view illustrating an adjacent area of the scooping portion 304 of a toner container 32Z according to a comparative example.

In the toner container 32Z illustrated in FIG. 22 according to the comparative example, a radially inner face 308Z is arc-shaped along the shutter side support 335*a* of the nozzle receiver 330. In this structure, the space (indicated by hatching in FIG. 22) inside the toner container 32Z to contain toner is not wide enough.

By contrast, in the toner container 32 according to the present embodiment illustrated in FIG. 21, only the radially inner end 3041 of the scooping portion 304 approaches most the shutter side support 335*a*, and the radially inner face 308 adjacent to the scooping portion 304 withdraws outward in the radial direction from the radially inner end 3041. In other words, in the present embodiment, a circumferential length of a portion of the inner face of the toner container 32 that reaches a position closest to (at a smallest distance a from) the shutter side support 335*a* is shorter compared with the comparative example. The circumferential length is a length along the circumference of the toner container 32 on the cross section perpendicular to the axis of the toner container 32.

Consequently, compared with the comparative example illustrated in FIG. 22, the space (indicated by hatching in FIG. 21) inside the toner container 32 except the nozzle receiver 330 is wider, and the toner can be dispersed better around the scooping portion 304 when the toner container 32 is set in the toner supply device 60.

As illustrated in FIGS. 14 and 15, when the toner container 32 is set in the toner supply device 60, the toner container 32 is pushed into the device body, and the end of the conveying nozzle 611 pushes the container shutter 332 into the toner container 32. At that time, the rear end of the guide rod 332*e* of the container shutter 332 is pushed closer to the container rear end than the rear end support 335, compressing the toner.

The compression force exerted on the toner by the guide rod 332*e* decreases as the internal space of the toner container 32 increases. That is, as the internal space becomes wider, the toner is less likely to hinder the container shutter 332 from moving in the direction to open the nozzle connecting opening 331 of the toner container 32.

Experiment

In an experiment, under conditions of a temperature of 25 $B!k (BC and a relative humidity (RH) of 50%, 365 g of toner was put in a toner container having a capacity of 730 $cm^3$, and the toner container was shaken up and down 10 times to fluidize the toner. The conveying nozzle 611 was inserted via the nozzle receiver 330 into the toner container 32. Then, the inventors confirmed that the container shutter 332 of the nozzle receiver 330 moved to a position to fully open the nozzle hole 610.

Thus, the inventors have confirmed that, in the toner container 32 according to the present embodiment, the toner does not hinder the movement of the container shutter 332 in setting the toner container 32 in the toner supply device 60 under the condition that the bulk density of the toner therein is not greater than 0.5 $g/cm^3$.

Embodiment 4 A toner container according to Embodiment 4 is described below. On the container rear end of the container body 33, the handle 303 is molded as a single piece with the container body 33. The handle 303 is used in attachment and removal of the toner container 32. In the toner container according to the present embodiment, the handle includes a slope that serves as an inner face of the container body, and the slope is sloped such that a front side of the slope descends lower than the rear side of the slope. The slope guides the toner retained inside the handle to the spiral rib as the container body rotates.

Figure 23:
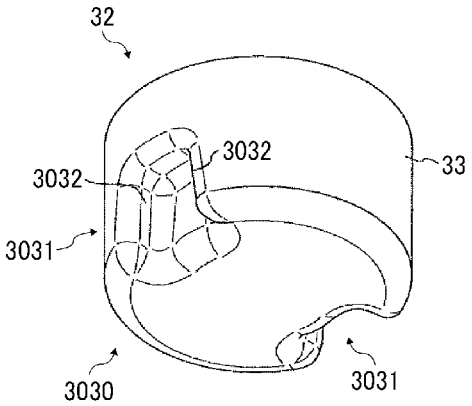
FIG. 23 is a perspective view of a rear portion of a toner container according to Embodiment 4.
Figure 24:
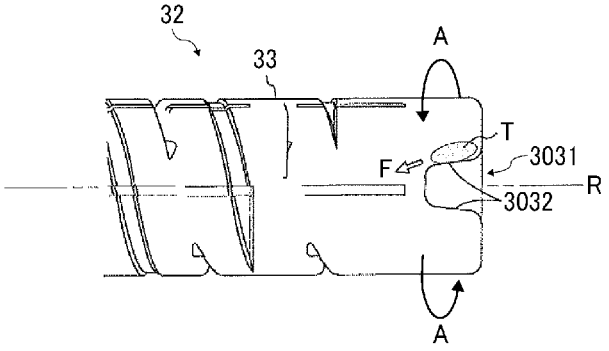
FIG. 24 is a side view of the rear portion of the toner container illustrated in FIG. 23.

FIG. 23 is a perspective view of a rear portion of a toner container according to Embodiment 4. FIG. 24 is a side view of the rear portion of the toner container according to Embodiment 4. FIG. 24 illustrates a state of the toner in a perspective view.

In the toner container 32 according to Embodiment 4, the container body 33 includes a handle 3030 that includes a pair of handle recesses 3031, which are portions of the outer face of the container body 33 recessed inward the container body 33. The two handle recesses 3031 are centrosymmetric with respect to the rotation axis R.

Each of the handle recesses 3031 includes a pair of slopes 3032 bent from the outermost face of the container body 33 and extending from the rear end of the container body 33 toward the container front end. The two slopes 3032 are inclined to guide the toner on the slope 3032 down from the rear side to the front side of the container body 33, in a state in which the rotation axis R is horizontal.

In other words, in a state in which the container body 33 is in the horizontal posture, as the container body 33 rotates, the slope 3032 reaches an upper side of the handle recess 3031. The slope 3032 is inclined such that the rear side of the upper slope 3032 in this state is higher than the front side thereof. Accordingly, the toner T on the slope 3032 slides down toward the container front side as indicated by arrow F in FIG. 24. Accordingly, the handle recess 3031 does not keep the toner on the rear end of the container body 33 but forwards the toner sequentially to the container front side as the container body 33 rotates.

Actions and Effects

Aspect 1

A powder container (the toner container 32) includes the substantially cylindrical container body (the container body 33) to contain powder and rotate around the axis (the rotation axis R) in a horizontal posture. The powder container further includes the substantially cylindrical mouth (the bottle mouth 33*a*) disposed at a first end of the container body in the axial direction and smaller in inner diameter than the container body. The container body includes a conveyor (the spiral rib 302) disposed inside the container body to convey the powder toward the mouth as the container body rotates. The container body further includes the scooping portion (the scooping portion 304) disposed deeper than the mouth in the container body in the axial direction. As the container body rotates, the scooping portion scoops the powder conveyed by the conveyor to a position above a powder inlet (the nozzle hole 610) of a conveying tube (the conveying nozzle 611) and drops the powder to the powder inlet. The conveying tube is inserted from the mouth into the container body. The container body includes a radially inner face (the radially inner face 308) continuous with an inner end of the scooping portion in the radial direction of the container body. The radially inner face (the radially inner face 308) extends in a direction crossing the scooping portion and disposed inner than an outermost face of the container body in the radial direction of the container body. The radially inner face extends from the inner rim of the mouth toward the opposite end of the container body in the axial direction. The radially inner face is not inner in the radial direction of the container body than a virtual cylinder extending from the inner rim of the mouth parallel to the axial direction.

According to this aspect, when the powder container is blow-molded, a significant thickness difference is less likely to occur around the front end 3043 of the container body. Accordingly, the parison for the powder container can be made thin entirely, and the amount of resin used and the weight of the powder container can be reduced.

Aspect 2

In the powder container (the toner container 32), the radially inner face 308 is either parallel to the axis (the rotation axis R) of the powder container or oblique to draw away from the axis of the container body from the first side (the front side or mouth side) toward the second side (the rear side or opposite side).

This aspect can attain effects similar to those attained in Aspect 1.

Aspect 3 In the powder container (the toner container 32), the scooping portion 304 has a shape recessed to the upstream side in the direction of rotation of the container body.

This shape enhances the capability of the scooping portion 304 to hold the powder.

Aspect 4

In the powder container (toner container 32), the scooping portion 304 includes a supply face (the supply face 3045) including the radially inner end 3041 and disposed on the first side (front side) in the axial direction and a conveying face (the conveying face 3046) including the rear end 3044. The supply face supplies the powder (toner) to the powder inlet (the nozzle hole 610). The conveying face conveys the powder (toner) to the supply face.

According to this aspect, as the container body rotates, the powder on the conveying face sequentially moves toward the supply face, and the powder is efficiently supplied from the supply face to the powder inlet.

Aspect 5

In the powder container (the toner container 32), the inclination of the scooping portion relative to the powder inlet (the nozzle hole 610) is set such that, when the angle of the scooping portion is at an angle of repose of the powder (toner), a line extending from the scooping portion toward the powder inlet is located between an opposite end of the powder inlet (farther end of the powder inlet from the scooping portion) and a center in the width direction of the powder inlet.

According to this aspect, the scooping portion can efficiently supply, to the powder inlet, the powder that is discharged at a relatively high speed from the scooping portion and falling in a linear trajectory following the inclination of the scooping portion. Since the scooping portion rises as the container body 33 rotates, the scooping portion can efficiently supply, to the powder inlet, even such powder that is discharged from the scooping portion 304 at a lower speed and falls along a trajectory shaper than the inclination of the scooping portion.

Aspect 6

The powder container (the toner container 32) according to this aspect is a blow-molded container.

Blow molding includes biaxial stretch blow molding and direct blow molding. In the powder container according to this aspect, the radially inner face 308 is not inner in the radial direction of the container body than a virtual cylinder extending from the inner rim of the mouth (bottle mouth 33*a*) and extending parallel to the axial direction. Accordingly, during molding, a significant thickness difference is less likely to occur around the front end 3043 of the container body 33. According to this aspect, since the parison for the powder container can be made relatively thin, the amount of resin used and the weight of the toner container can be reduced.

Aspect 7

An image forming apparatus (the image forming apparatus 500) includes an image forming device (the printer body 100) to form an image on an image bearer (the photoconductor 41) using powder (toner), a powder conveyance device (the toner supply device 60) to convey the powder to the image forming device, and a powder container (the toner container 32) to be removably held by the powder conveyance device. The powder container according to any one of Aspects 1 through 6 is used.

This aspect can attain effects similar to those attained in the corresponding one or more of Aspects 1 through 6.

This patent application is based on and claims priority pursuant to 35 U.S.C. $B!x (B119(a) to Japanese Patent Application No. 2016-180976, filed on Sep. 15, 2016, in the Japan Patent Office, the entire disclosure of which is hereby incorporated by reference herein.

REFERENCE SIGNS LIST

26 sheet feeding tray
27 Feed roller
28 Registration roller pair
29 Sheet ejection roller
30 Sheet stack section
32 Toner container (Powder container)
33 Container body (Powder storage)
33*a* Bottle mouth
33*b* Screw
34 Container end cover (Container cover)
34*a* Gear exposing window
34*b* Color discrimination rib
41 Photoconductor (Image bearer)
42 Photoconductor cleaning device
42*a* Cleaning blade
44 Charging roller
46 Image forming device
47 Exposure device
48 Intermediate transfer belt
49 Primary-transfer bias roller
50 Developing device
51 Developing roller
52 Doctor blade
53 First developer containing compartment
54 Second developer containing compartment
55 Developer conveying screw
56 Toner concentration sensor
60 Toner supply device (Powder conveyance device)
64 Downward toner passage
70 Toner container mount
71 Insertion hole part
72 Container receiving section
73 Container cover section (End portion receiving section)
82 Secondary-transfer backup roller
85 Intermediate transfer unit
86 Fixing device
89 Secondary transfer roller
90 Controller (Information processor)
91 Driving part
100 Printer body (Image forming device)
200 Sheet feeder
301 Container gear
302 Spiral rib
303 Handle
3030 Handle
3031 Handle recess
3032 Slope
304 Scooping portion
3041 Radially inner end
3042 Radially outer end
3043 Front end
3044 Rear end
3045 Supply face (Supply portion)
3046 Conveying face (Conveying portion)
305 Front opening (Opening forming portion)
306 Cover hook catch
307 Shoulder top (End face)
308 Radially inner face
330 Nozzle receiver (Tube receiving portion)
331 Nozzle connecting opening (Tube receiving hole)
332 Container shutter
332*a* Shutter retaining hook
332*b* Second shutter retaining hook
332*c* Cylindrical end part
332*d* Slide portion
332*e* Guide rod
332*f* Cantilever
333 Container seal
335 Rear end support
335*a* Side support
335*b* Shutter supporter slot
336 Container shutter spring
337 Receiver securing ring
337*a* Contact rib
339 Container lock
339*a* Guide projection
339*b* Guide groove
339*c* Overstridden portion
339*d* Retaining hole
340 Container shutter supporter
341 Cover hook
361 Slide guide
361*a* Slide groove
400 Scanner
500 Image forming apparatus (Copier)
601 Container drive gear
602 Frame
603 Drive motor
603*a* Worm gear
604 Drive transmission gear
605 Conveying screw gear
607 Nozzle holder
608 Socket
609 Device-side lock (Container lock member)
610 Nozzle hole (Powder inlet)
611 Conveying nozzle (Conveying tube)
612 Nozzle shutter (Powder inlet opening and closing member)
612*a* Nozzle shutter flange (Contact portion)
613 Nozzle shutter spring (Biasing member)
614 Conveying screw
615 Container setting section
640 Movable spring
700 ID tag (ID chip, Memory)
800 Connector
G Developer
L Laser light
P Recording medium
R Rotation axis

The invention claimed is:

1. A powder container comprising:

a container body having a substantially cylindrical shape, the container body to contain powder and rotate around an axis in a horizontal posture;

a mouth molded with the container body as a single piece, the mouth having a cylindrical shape smaller in inner diameter than the container body, the mouth at a first end of the container body in an axial direction of the container body, the mouth into which a conveying tube having a powder inlet is inserted;

a conveyor inside the container body to convey the powder toward the mouth as the container body rotates;

a scooping portion deeper in the container body than the mouth in the axial direction and raised toward the axis of the container body to reduce an inner diameter of the container body; and a radially inner face continuous with an inner end of the scooping portion in a radial direction of the container body, the radially inner face extending in a direction crossing the scooping portion and inward in the radial direction than an outermost face of the container body, wherein the scooping portion is configured to lift the powder inside the container body, to a position above the powder inlet of the conveying tube, and drop the powder to the powder inlet as the container body rotates, wherein the radially inner face extends from the mouth toward a second end of the container body opposite the first end in the axial direction, and wherein the radially inner face does not extend in the radial direction inside a virtual cylinder extending from an inner rim of the mouth parallel to the axial direction.

2. The powder container according to claim 1, wherein the radially inner face is either parallel to the axis of the container body or oblique to draw away from the axis of the container body from the first end toward the second end of the container body.

3. The powder container according to claim 1, wherein the scooping portion has a shape recessed to an upstream side in a direction of rotation of the container body.

4. The powder container according to claim 1, wherein the scooping portion includes:

a supply face including a radially inner end on a first end side in the axial direction, the supply face to supply the powder to the powder inlet, and a conveying face including an end of the scooping portion on a second end side in the axial direction, the conveying face to convey the powder to the supply face.

5. The powder container according to claim 1, wherein the scooping portion has such an inclination relative to the powder inlet that, when the scooping portion is at an angle of repose of the powder, a line extending from the scooping portion toward the powder inlet is located between a farther end of the powder inlet from the scooping portion and a center of the powder inlet in a width direction perpendicular to the axial direction.

6. The powder container according to claim 1, wherein the powder container is a blow-molded container.

7. An image forming apparatus comprising:

an image forming device including an image bearer, the image forming device to form an image on the image bearer;

a powder conveyance device to convey the powder to the image forming device; and a powder container according to claim 1, to be removably held by the powder conveyance device.

* * * * *